US006130504A

United States Patent [19]

Nakayama et al.

[11] Patent Number: 6,130,504

[45] Date of Patent: Oct. 10, 2000

[54] PLASMA ADDRESSING DISPLAY DEVICE AND METHOD FOR PRODUCING THE SAME

[75] Inventors: Junichiro Nakayama, Shiki-gun; Kensuke Goto, Tenri; Tadashi Une, Shiki-gun; Satoru Ariyoshi, Tajimi; Kunio Kojima, Nabari; Yoshihiko Minamiyama, Tenri; Yoshihiro Yamamoto, Nara, all of Japan

[73] Assignee: Sharp Kabushiki Kaisha, Osaka, Japan

[21] Appl. No.: 09/113,282

[22] Filed: Jul. 10, 1998

[30] Foreign Application Priority Data

Jul. 11, 1997 [JP] Japan ..... 9-187009
Sep. 19, 1997 [JP] Japan ..... 9-255603

[51] Int. Cl.[7] ..... H01J 17/49; H01J 9/00; H01J 9/24

[52] U.S. Cl. ..... 313/584; 313/582; 313/587; 445/24

[58] Field of Search ..... 313/582, 584, 313/585, 586, 587; 445/24

[56] References Cited

U.S. PATENT DOCUMENTS

| | | | |
|---|---|---|---|
| 5,313,223 | 5/1994 | Buzak et al. . | |
| 5,461,395 | 10/1995 | Stein . | |
| 5,800,232 | 9/1998 | Miyazaki | 445/24 |
| 5,838,106 | 11/1998 | Funada | 313/587 |
| 6,019,655 | 2/2000 | Hayashi et al. | 445/24 |

FOREIGN PATENT DOCUMENTS 6-251719 9/1994 Japan .

OTHER PUBLICATIONS

Patent Abstracts of Japan, No. 06251719, Sep. 9, 1994, "Discharging Cell and Manufacture Threof", Masayasu, (Sony Corp).

Patent Abstracts of Japan, No. 06222346, Dec. 8, 1994, "Electrode Structural Body For Plasma Address Assigning Device", Maatein et al., (Sony Tektronix Corp).

*Primary Examiner*—Nimeshkumar D. Patel
*Assistant Examiner*—Michael J. Smith
*Attorney, Agent, or Firm*—Nixon & Vanderhye, P.C.

[57] ABSTRACT

A plasma addressing display device of the present invention includes: a plasma addressing substrate; a color filter substrate; and a display medium layer interposed between the plasma addressing substrate and the color filter substrate is provided. The plasma addressing substrate includes: a first substrate; a dielectric sheet provided near the display medium layer; a plurality of electrode lines provided at regular intervals on the first substrate; a plurality of partition walls provided respectively on the plurality of electrode lines; and a plurality of strip plasma discharge channels each enclosed by the first substrate, the dielectric sheet and the partition walls. The color filter substrate includes: a second substrate; a color filter layer provided on the second substrate; a plurality of strip electrodes provided on the color filter layer so as to extend in a direction orthogonal to the plurality of strip plasma discharge channels. A picture element is defined by a region where adjacent two of the plasma discharge channels overlap one of the plurality of strip electrodes.

13 Claims, 22 Drawing Sheets

PLASMA ADDRESSING DISPLAY DEVICE AND METHOD FOR PRODUCING THE SAME

BACKGROUND OF THE INVENTION

1. Field of the Invention

The present invention relates to a plasma addressing display device and a method for producing the same.

2. Description of the Related Art

The development of a display device, such as a flat panel display, has been directed to small-screen, monochromatic and binary displays. Past this initial stage of the display device development, efforts are now directed to develop larger-screen, multi-color, grayscale and/or motion picture displays. The performance of the devices in this field has been steadily improved each year.

Hereinafter, the structure and the operation principle of a conventional plasma addressing display device 10, as one example of such a display device, will be described with reference to FIGS. 15 and 16A to 16F.

As illustrated in FIG. 15, the plasma addressing display device 10 includes a color filter substrate 50A and a plasma addressing substrate 50B, interposing a liquid crystal layer 46 which is provided by injecting a liquid crystal material therebetween. The display device 10 is further provided with a backlight 50.

The color filter substrate 50A includes a polarizer 41*a*, a transparent substrate 42*a*, a color filter 43, a transparent electrode line 44 and an alignment film 45*a*. On the other hand, the plasma addressing substrate 50B includes a polarizer 41*b*, a transparent substrate 42*b*, a partition wall 48, electrode lines (e.g., an anode 49A and a cathode 49C), a dielectric sheet (a thin transparent substrate) 47 and an alignment film 45*b*.

The plasma addressing substrate 50B includes a plurality of plasma discharge channels 50C each being a space enclosed by the transparent substrate 42*b*, two adjacent partition walls 48 and the dielectric sheet 47. The plasma discharge channels 50C each contain a noble gas, such as He, Ne, Ar and Xe, at a gas pressure of about 10 Pa to about $10^4$ Pa, preferably about $10^2$ Pa to about $5\times10^3$ Pa. The transparent electrode line is linearly arranged so that the transparent electrode line 44 orthogonally crosses over the plasma discharge channel 50C, which is also linearly arranged but in a different direction. Each region where the transparent electrode line 44 and the plasma discharge channel 50C overlap each other corresponds to a picture element of the color filter 43.

Hereinafter, the operation of the plasma addressing substrate 50B will be briefly described with reference to FIGS. 16A to 16F.

Writing and holding of information are performed in the following manner.

First, as illustrated in FIG. 16A, a voltage of about 100 V to about 500 V is applied between the anode 49A and the cathode 49C, i.e., a voltage Ec of about −300 V to about −450 V is applied to the cathode 49C, thereby causing an electric discharge.

Throughout the accompanying figures, a black circle (●) and a white circle (○) represent a negatively-charged and a positively-charged particles, respectively.

Then, a voltage Ed of about +50 V to about +100 V is applied to the transparent electrode line 44 of the color filter substrate 50A, as illustrated in FIG. 16B, thereby writing information, and then the electric discharge is discontinued so as to negatively charge the dielectric sheet 47 interface, as illustrated in FIG. 16C, thereby holding the written information.

On the other hand, in order to positively charge the dielectric sheet 47 interface, a voltage Ed of about −50 V to about −100 V is applied to the transparent electrode line 44 of the color filter substrate 50A, and then the electric discharge is discontinued, as illustrated in FIGS. 16D to 16F.

FIG. 17A illustrates a change over time of the voltage Ec, and FIG. 17B illustrates a change over time of the voltage Ed. In FIGS. 17A and 17B, time periods "a" to "f" correspond to FIGS. 16A to 16F, respectively.

The above-described conventional plasma addressing display device 10 has a low aperture ratio, and thus a low brightness, due to the presence of the electrode lines (e.g., the anode 49A and the cathode 49C). In order to mitigate such a problem, the backlight performance has to be improved, for example, which increases the cost of the device.

Japanese Laid-open Publication No. 6-222346 proposes a plasma addressing display device in which an insulative partition wall is provided on each electrode line. However, as described in paragraphs [0059] to [0062] on page 7 of Japanese Laid-open Publication No. 6-222346, one problem of the device of this publication is that the voltage to be applied to the electrode line is complicated.

Japanese Laid-open Publication No. 6-251719 proposes a discharge cell and a method for producing the same in which an anode is provided directly under a partition wall with a width larger than that of the partition wall, in order to increase the tolerance for the position of the electrode line, thereby facilitating the production of the device, and to increase the aperture ratio thereof. However, even the device of this publication can only realize an aperture ratio of about 40%.

SUMMARY OF THE INVENTION

According to one aspect of this invention, a plasma addressing display device includes: a plasma addressing substrate; a color filter substrate; and a display medium layer interposed between the plasma addressing substrate and the color filter substrate is provided. The plasma addressing substrate includes: a first substrate; a dielectric sheet provided near the display medium layer; a plurality of electrode lines provided at regular intervals on the first substrate; a plurality of partition walls provided respectively on the plurality of electrode lines; and a plurality of strip plasma discharge channels each enclosed by the first substrate, the dielectric sheet and the partition walls. The color filter substrate includes: a second substrate; a color filter layer provided on the second substrate; a plurality of strip electrodes provided on the color filter layer so as to extend in a direction orthogonal to the plurality of strip plasma discharge channels. A picture element is defined by a region where adjacent two of the plasma discharge channels overlap one of the plurality of strip electrodes.

In one embodiment of the invention, a width of a portion of the partition wall in a vicinity of a junction between the partition wall and the electrode line is less than a width of a remaining portion of the partition wall.

In one embodiment of the invention, a width of the partition wall and a width of the electrode line are identical to each other and constant in a height direction.

According to another aspect of this invention, a method for producing a plasma addressing display device includes the steps of: (a) printing an electrode material on a first substrate so as to form an electrode line on the first substrate; (b) printing a partition wall material on the electrode line so as to form a first portion of a partition wall which has a width less than a width of the electrode line; and (c) printing a partition wall material on the first portion so as to form a remaining portion of the partition wall which has a width greater than the width of the first potion.

In one embodiment of the invention, the remaining portion of the partition wall has a width substantially identical to the width of the electrode line.

In one embodiment of the invention, in the steps (b) and (c), the partition wall material is printed iteratively.

According to still another aspect of this invention, a method for producing a plasma addressing display device includes the steps of: depositing an electrode material film and an insulative partition wall material film in this order on a first substrate; partially etching away the electrode material film and the insulative partition wall material film using a mask or a resist so as to form a plurality of electrode lines and a plurality of partition walls; and providing a second substrate on the plurality of partition walls; and introducing an inert gas into a space defined by the first substrate, the second substrate and the plurality of partition walls, thereby forming a plasma discharge channel.

According to still another aspect of this invention, a plasma addressing display device including: a plasma addressing substrate; a color filter substrate; and a display medium layer interposed between the plasma addressing substrate and the color filter substrate is provided. The plasma addressing substrate includes: a first substrate; a dielectric sheet provided near the display medium layer; a plurality of partition walls provided at regular intervals on the first substrate; a plasma discharge channel formed by introducing a gas into a space enclosed by the first substrate, the dielectric sheet and the partition walls. Two electrode lines are provided on the first substrate so as to be at least partially buried in respective sides of the partition wall and insulated from each other by the partition wall.

In one embodiment of the invention, the partition wall includes a notch portion where the electrode lines are buried, and a width of the notch portion is less than a width of a remaining portion of the partition wall.

In one embodiment of the invention, the two electrode lines are entirely buried in respective sides of the partition wall.

In one embodiment of the invention, one of the two electrode lines are an anode and a cathode, respectively, and a voltage necessary for causing an electric discharge is applied to the cathode.

In one embodiment of the invention, a color filter substrate including a color filter and a strip electrode is provided on the dielectric sheet, and a voltage necessary for writing data is applied to the strip electrode.

In one embodiment of the invention, the plasma discharge channel and the strip electrode line are orthogonal to each other, and a picture element is defined by a region where the plasma discharge channel and the strip electrode overlap each other.

According to still another aspect of this invention, a method for producing a plasma addressing display device includes the steps of: forming an electrode line pattern on a first substrate with a gap which corresponds to a separation between two electrode lines insulated from each other by a partition wall; depositing an insulative material layer on the electrode line pattern including the gap; partially etching away the electrode line pattern and the insulative material layer so as to leave a portion of the electrode line pattern on each side of the gap, thereby forming the partition wall and the electrode lines, the electrode lines opposing each other in parallel and at least partially buried on respective sides of the partition wall in a vicinity of the first substrate; providing a dielectric sheet on the partition walls; and introducing a gas into a space enclosed by the first substrate, the dielectric sheet and the partition walls, thereby forming a plasma discharge channel.

Hereinafter, the function of the present invention will be described.

According to the present invention, each region where two plasma discharge channels overlap one transparent electrode line corresponds to a picture element of the color filter. Such a display device can be driven by employing a conventional driving method by applying a predetermined potential to the middle one of three adjacent electrode lines included in each picture element, while setting the outer ones of the three adjacent electrode lines at a ground potential. Thus, it is possible to increase the aperture ratio while employing the conventional driving method, as illustrated in FIGS. 16A to 16F.

In the case where the partition wall is formed on the electrode line with their widths being identical to each other, the electrode line can still be exposed to the gas contained in the plasma discharge channel, by forming the partition wall so that a portion of the partition wall in the vicinity of the electrode line has a width smaller than that of the other portion of the partition wall. In such a case, the partition wall and the electrode line will create a single, overlapping light blocking area, whereby the aperture ratio is further increased. Furthermore, since the exposed area of the electrode line can be thus increased, the electric discharge is stabilized.

Also when the partition wall and the electrode line are formed to have an identical width along their entire extent in the height direction, the partition wall and the electrode line will create a single, overlapping light blocking area. Therefore, the aperture ratio is increased, and there is only little change over time in the edges of the electrode lines, thereby enhancing the reliability of the device. Such a plasma addressing display device can be easily produced by employing a conventional printing process.

According to a production method of the present invention, a printing method is not employed in forming the partition wall, thereby eliminating the need for a complicated printing technique such as precise alignment. Moreover, since the electrode line is buried in the partition wall formed of an insulative material, there is only little change over time in the edges of the electrode lines, thereby enhancing the reliability of the device, and the formation of the electrode line is facilitated.

According to another aspect of the present invention, two electrode lines are formed to be buried in respective sides of the partition wall, which is part of the plasma discharge channel, so that the electrode lines are isolated from each other by the partition wall. In such a case, the aperture ratio is increased while it is possible to employ a driving method similar to the conventional driving method illustrated in FIGS. 16A to 16F.

The electric discharge is more effective when a notch is provided in the partition wall by reducing the width of a portion of the partition wall where the two electrode lines are buried.

Moreover, when the two electrode lines are formed to be entirely buried in the respective sides of the partition wall so that the electrode lines are insulated from each other by the partition wall, the aperture ratio is further increased.

Thus, the invention described herein makes possible the advantages of (1) providing a plasma addressing display device with an increased aperture ratio; and (2) providing a method for producing the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, illustrative examples of the present invention will be described in detail with reference to the accompanying figures.

EXAMPLE 1

First, a plasma addressing display device 100 according to Example 1 of the present invention will be described with reference to FIGS. 1 and 2.

Figure 1:
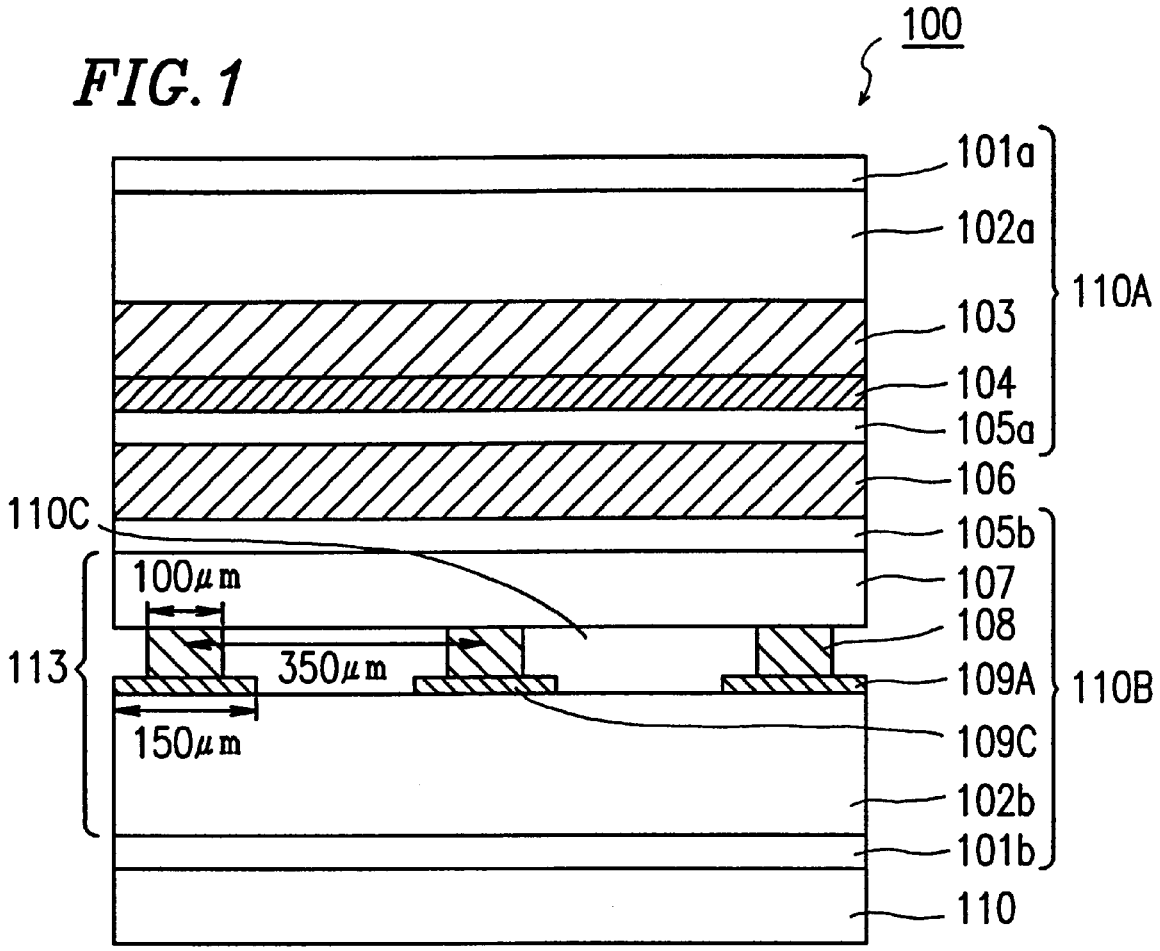
FIG. 1 is a cross-sectional view illustrating the plasma addressing display device according to Example 1 of the present invention.

FIG. 1 is a cross-sectional view illustrating the plasma addressing display device 100 according to Example 1 of the present invention. FIG. 2 is an exploded perspective view for illustrating the positional relationship between a plasma addressing channel and a transparent electrode line in a plasma addressing display device. The relationship illustrated in FIG. 2 applies to the plasma addressing display devices of Examples 2 and 3 below, as well as the display device 100 of Example 1.

As illustrated in FIG. 1, the plasma addressing display device 100 includes a color filter substrate 110A and a plasma addressing substrate 110B on which a plasma addressing section 113 is formed, interposing a liquid crystal layer 106 which is provided by injecting a liquid crystal material therebetween. The display device 100 further includes a backlight 110 which is provided on the plasma addressing substrate 110B side of the display device 100.

The color filter substrate 110A includes: a polarizer 101*a*; a transparent substrate 102*a* formed of a glass with a thickness of about 0.5 mm to about 2.0 mm; a color filter 103; a transparent electrode line 104 formed of ITO, $SnO_2$, ITO+$SnO_2$, or the like; and an alignment film 105*a* formed of a polymer film. On the other hand, the plasma addressing substrate 110B in which the plasma addressing section 113 is formed includes: a polarizer 101*b;* a transparent substrate 102*b* formed of a glass with a thickness of about 0.5 mm to about 3.0 mm; a partition wall 108 formed of $SiO_2$, or the like; an electrode line (e.g., an anode 109A and a cathode 109C) formed of a metal such as Ni or Al; a dielectric sheet (a thin transparent substrate) 107 formed of a glass with a thickness of about 10 $\mu$m to 100 $\mu$m; and an alignment film 105*b* formed of a polymer film.

The plasma addressing substrate 110B includes a plurality of the plasma discharge channels 10C each being a space enclosed by the transparent substrate 102*b*, two adjacent partition walls 108 and the dielectric sheet 107. The plasma discharge channels 110C each contain a noble gas, such as He, Ne, Ar and Xe, at a gas pressure of about 10 Pa to about $10^4$ Pa, preferably about $10^2$ Pa to about $5\times10^3$ Pa.

Figure 2:
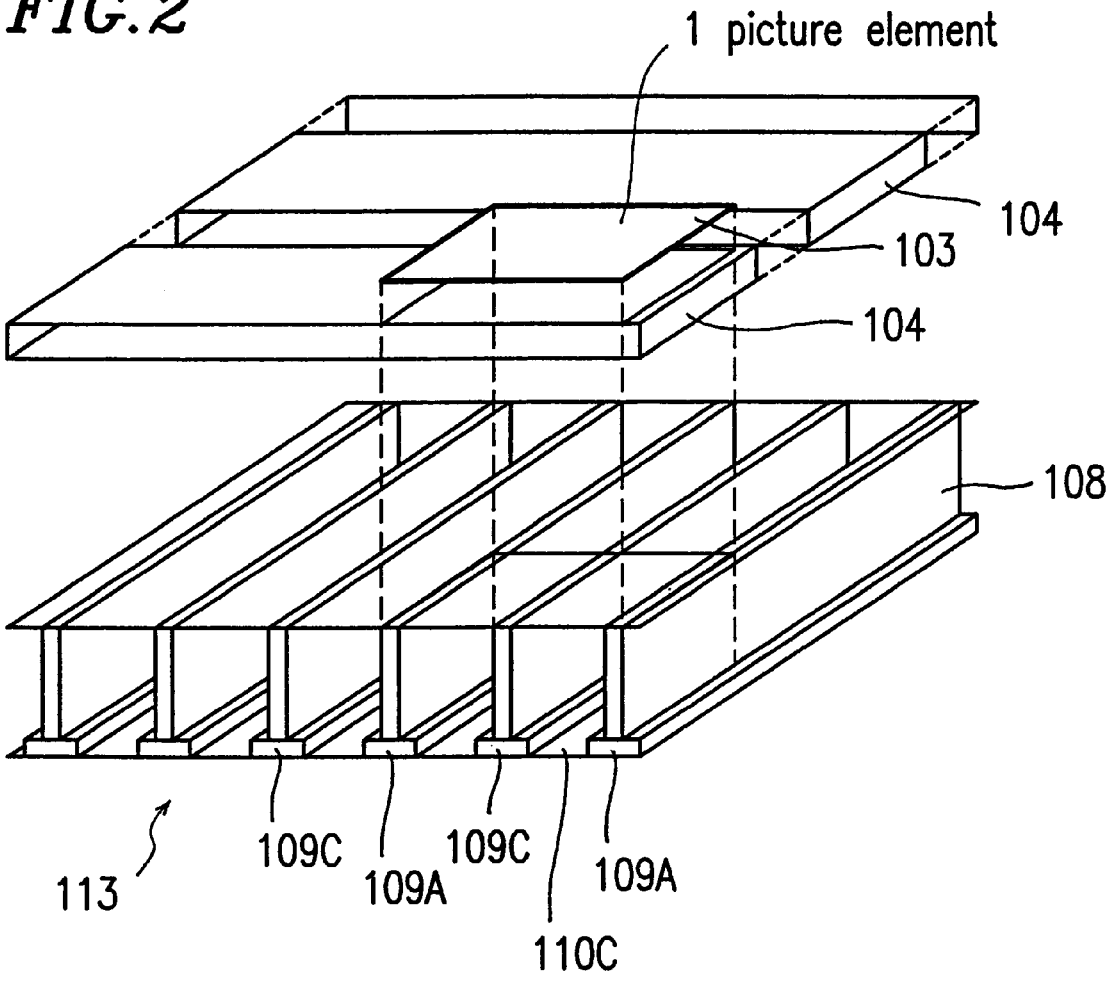
FIG. 2 is an exploded perspective view for illustrating the positional relationship between a plasma addressing channel and a transparent electrode line in the plasma addressing display devices according to Examples 1 to 3 of the present invention.

FIG. 2 is a perspective view for illustrating the positional relationship of the color filter 103, the transparent electrode line 104 and the plasma discharge channel 10C of the device 100. The plasma discharge channel 10C of the plasma addressing section 113 and the transparent electrode line 104 are in a "skew relationship" with respect to each other (i.e., in different planes and not parallel to each other). Each region where two plasma discharge channels 10C overlap one transparent electrode line 104 corresponds to a picture element of the color filter 103.

Hereinafter, the operation of the plasma addressing section 113 will be briefly described with reference to FIGS. 3A to 3F.

The plasma addressing section 113 includes a plurality of the plasma discharge channels 110C each being a space enclosed by the transparent substrate 102*b*, two adjacent partition walls 108 and the dielectric sheet 107. The plasma discharge channels 110C each contain a noble gas, such as He, Ne, Ar and Xe, at a gas pressure of about 10 Pa to about $10^4$ Pa, preferably about $10^2$ Pa to about $5\times10^3$ Pa.

Writing and holding of information are performed in the following manner.

Figure 3A:
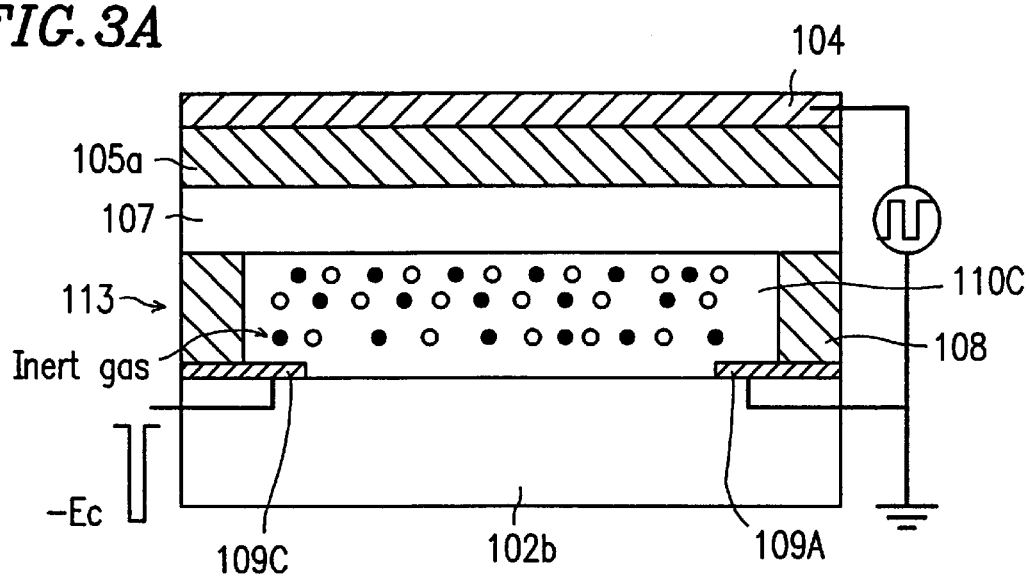
FIGS. 3A to 3F are cross-sectional views illustrating the operation of the plasma addressing display devices according to Examples 1 to 3 of the present invention.

First, as illustrated in FIG. 3A, a voltage of about 100 V to about 500 V is applied between the anode 109A and the cathode 109C, i.e., a voltage Ec of about −300 V to about −450 V is applied to the cathode 109C, thereby causing an electric discharge.

Figure 3B:
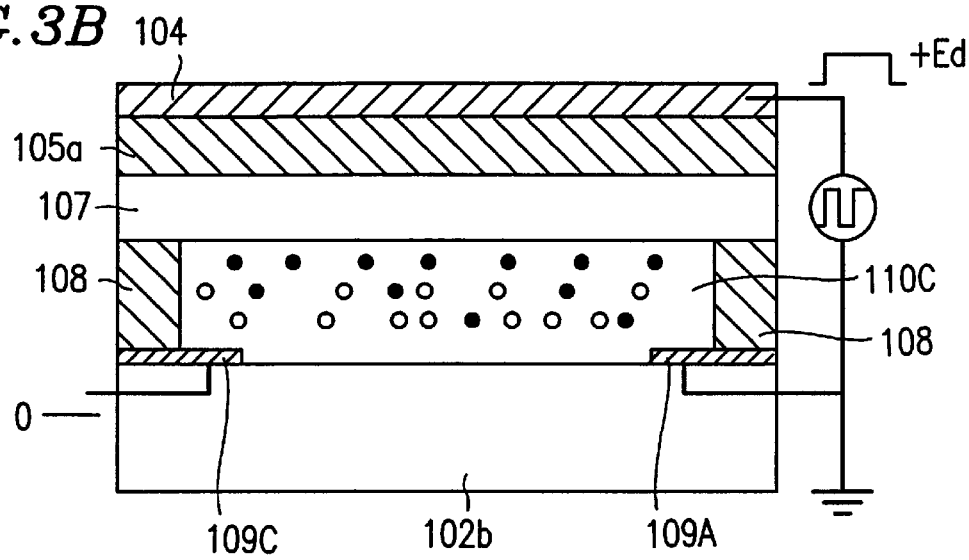
Figure 3C:
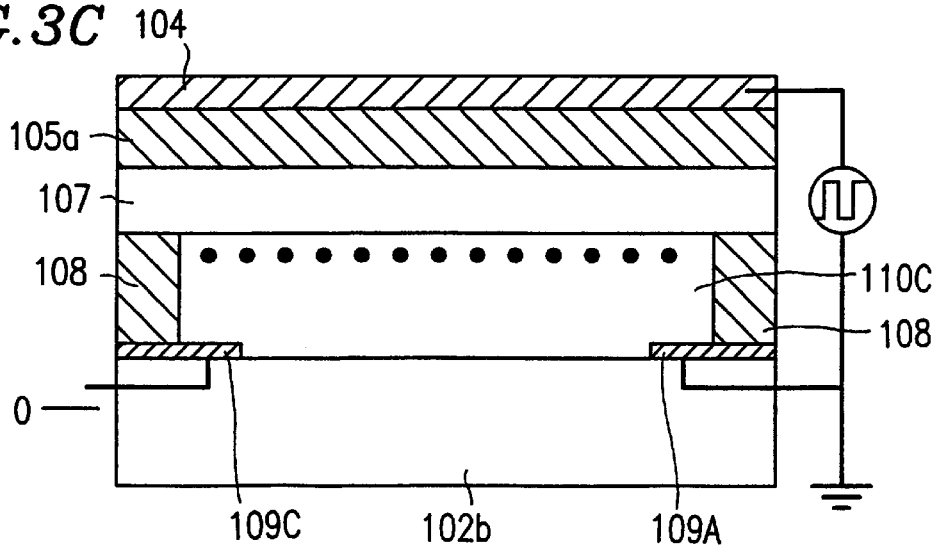

Then, a voltage Ed of about +50 V to about +100 V is applied to the transparent electrode line 104 of the color filter substrate 110A, as illustrated in FIG. 3B, thereby writing information, and then the electric discharge is discontinued so as to negatively charge the dielectric sheet 107 interface, as illustrated in FIG. 3C, thereby holding the written information.

Figure 3D:
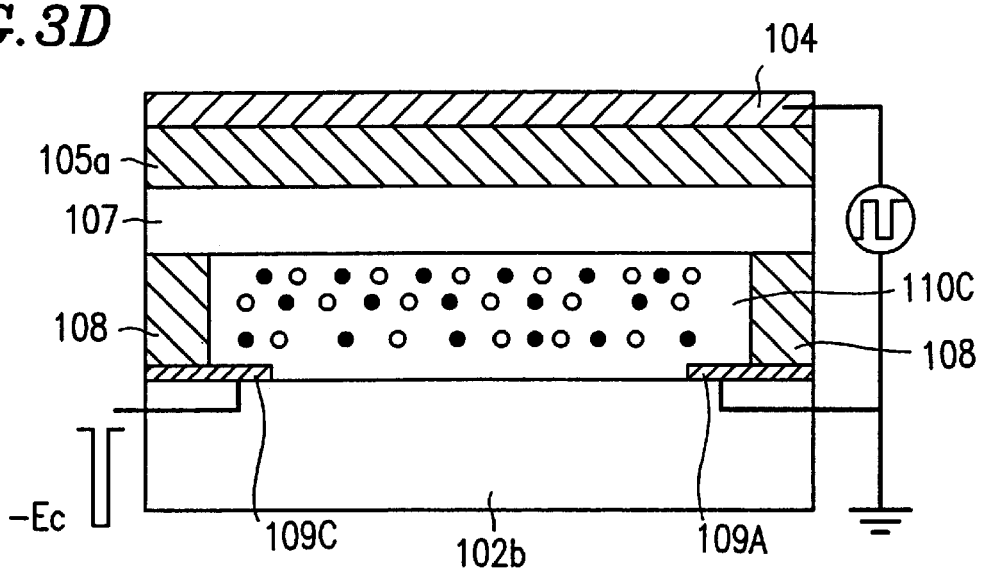
Figure 3E:
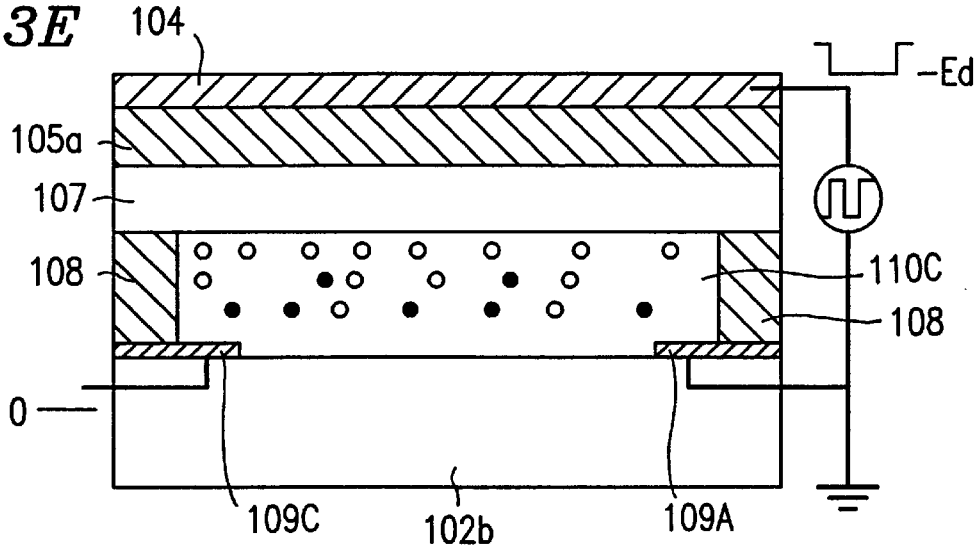
Figure 3F:
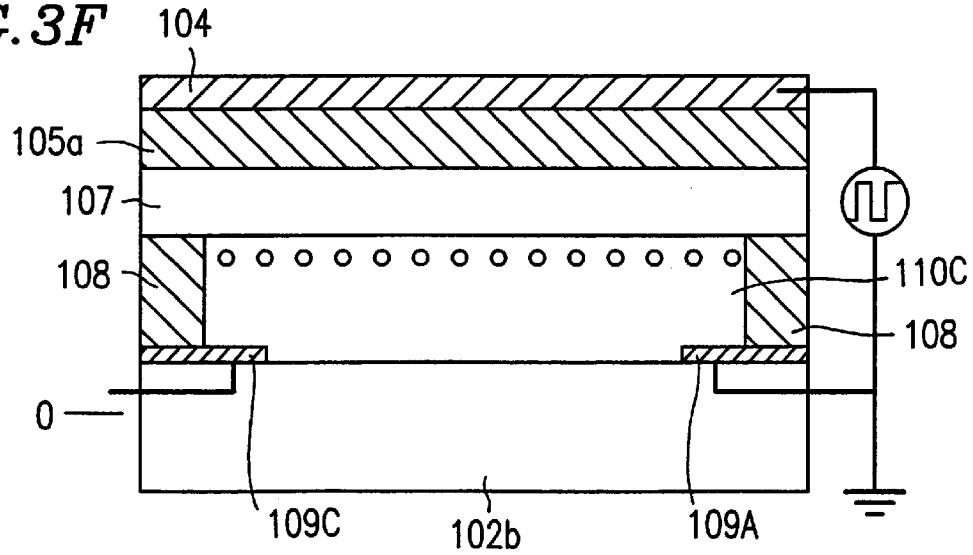

On the other hand, the dielectric sheet 107 interface may also be positively charged in a manner illustrated in FIGS. 3D to 3F. First, a voltage of about 100 V to about 500 V is applied between the anode 109A and the cathode 109C, i.e., the voltage Ec of about −300 V to about −450 V is applied to the cathode 109C, thereby causing an electric discharge.

Then, a voltage Ed of about −50 V to about −100 V is applied to the transparent electrode line 104 of the color filter substrate 110A, as illustrated in FIG. 3E, thereby writing information, and then the electric discharge is discontinued, as illustrated in FIG. 3F, so as to positively charge the dielectric sheet 107 interface, thereby holding the written information.

The potential adjustment for the above-described writing and holding of information is performed by applying a predetermined potential to the middle one of the three adjacent electrode lines of one picture element, while setting the outer ones of the three adjacent electrode lines at a ground potential.

As illustrated in FIG. 1, according to the present example, the width of the partition walls 108 is about 100 μm, with the distance between the centers of two adjacent partition walls 108 being about 350 μm, and the width of the electrode line (e.g., the anode 109A and the cathode 109C) is about 150 μm. Thus, the aperture ratio is about $[1-\{(150/2)\times2\}/350]\times100\approx57\%$.

Figure 15:
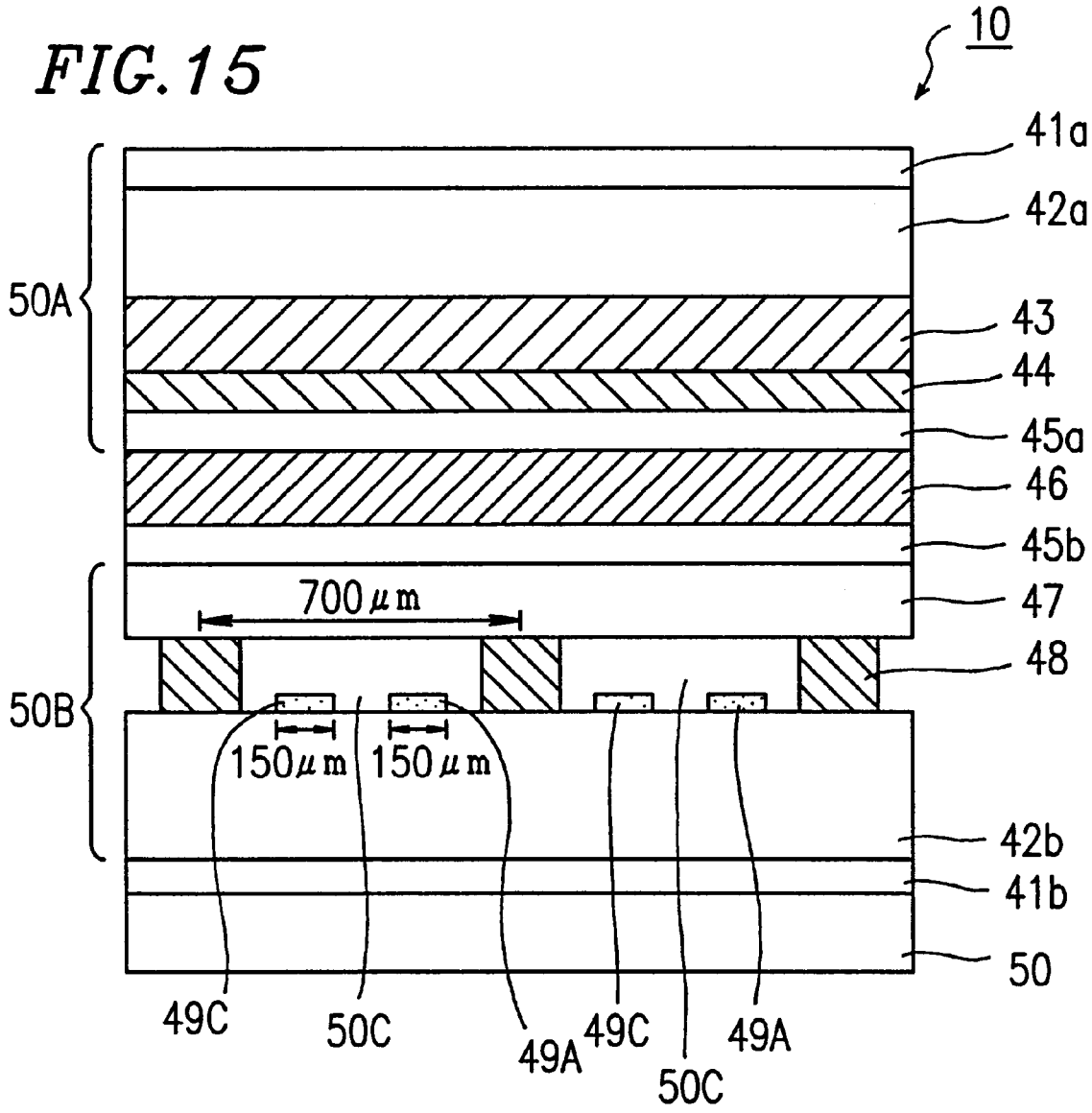
FIG. 15 is a cross-sectional view illustrating a conventional plasma addressing display device.
Figure 16A:
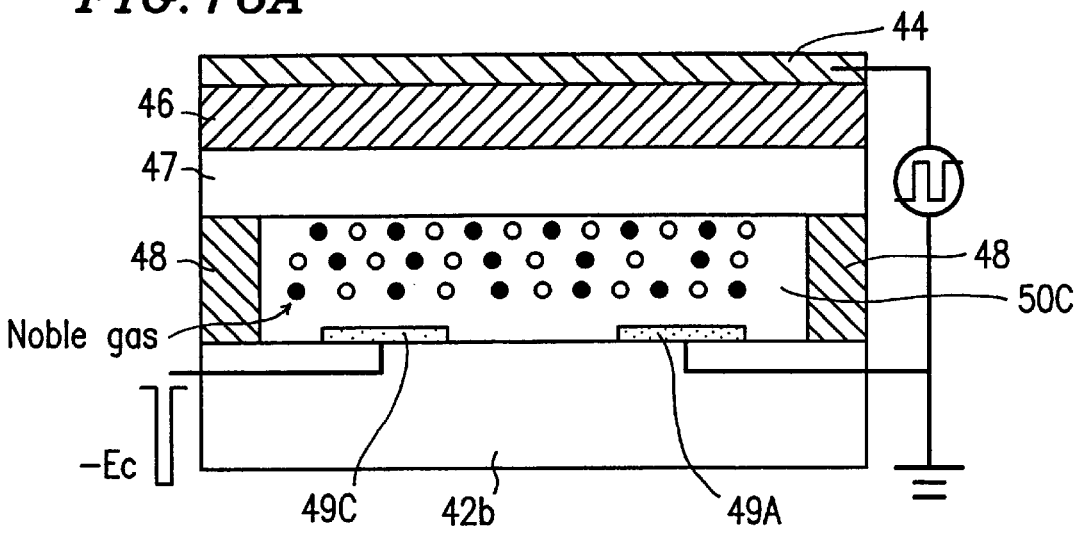
FIGS. 16A to 16F are cross-sectional views illustrating the operation of the conventional plasma addressing display device.
Figure 16B:
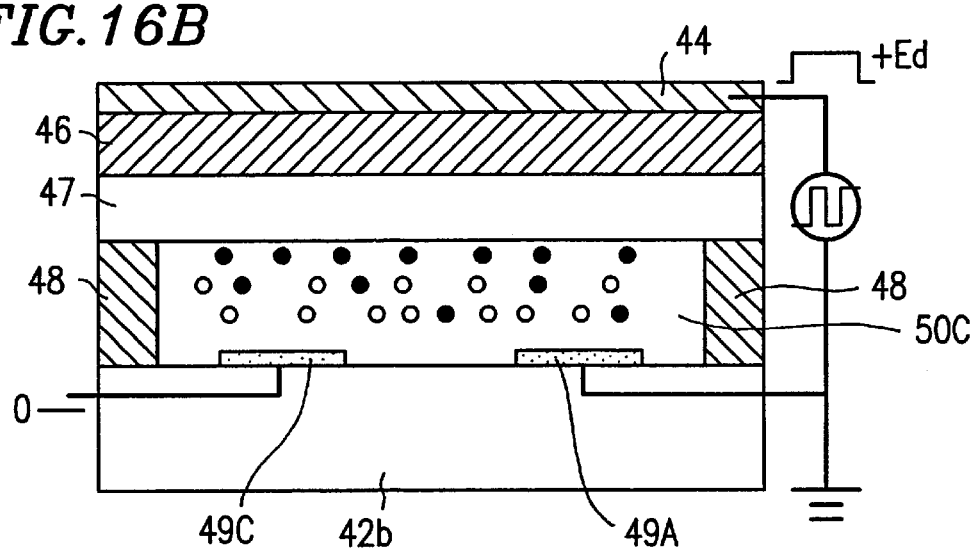
Figure 16C:
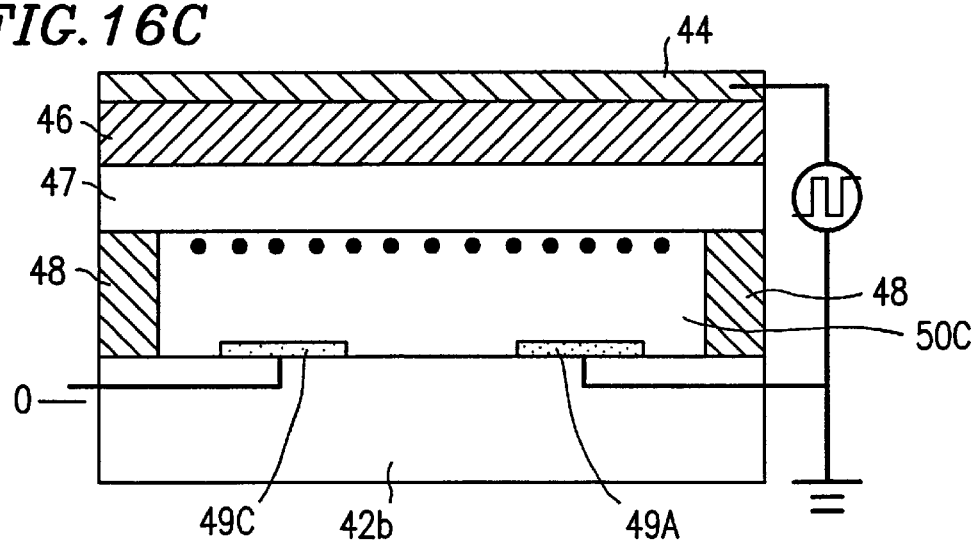
Figure 16D:
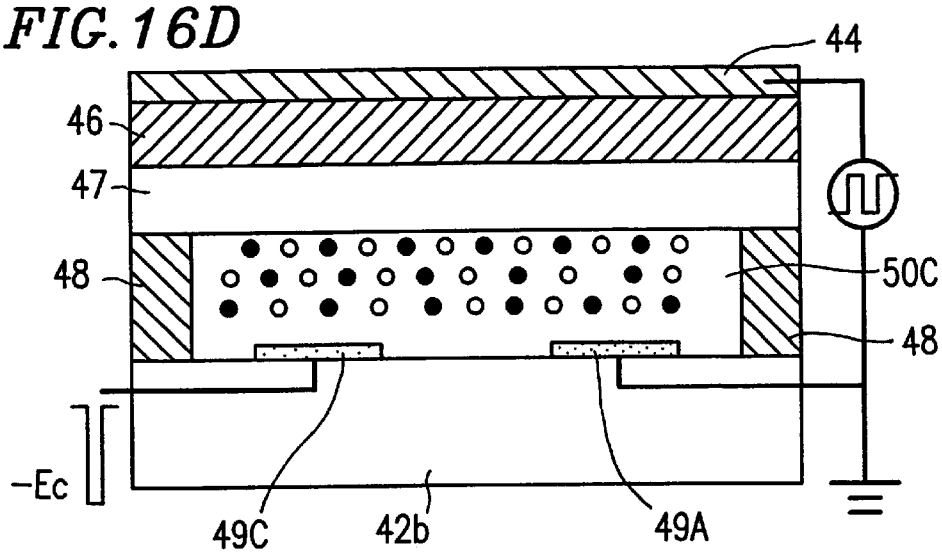
Figure 16E:
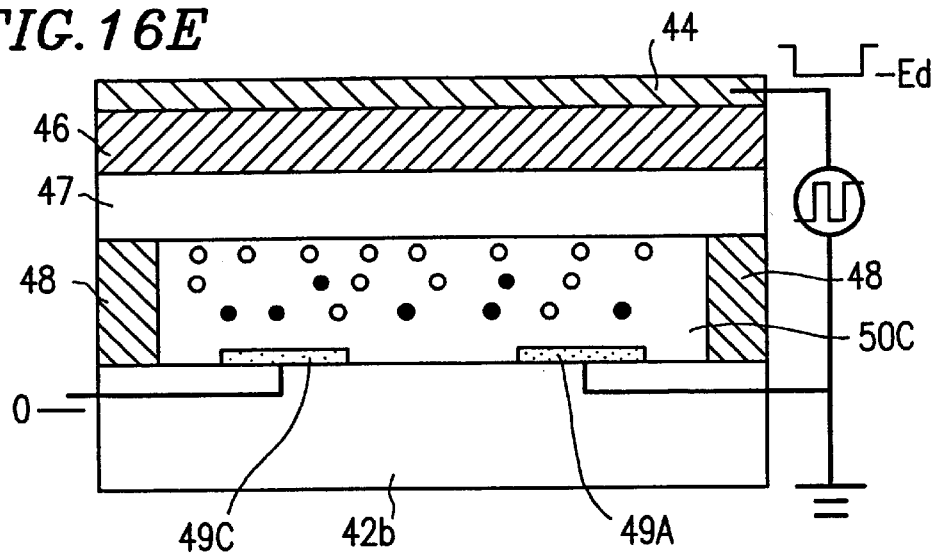
Figure 16F:
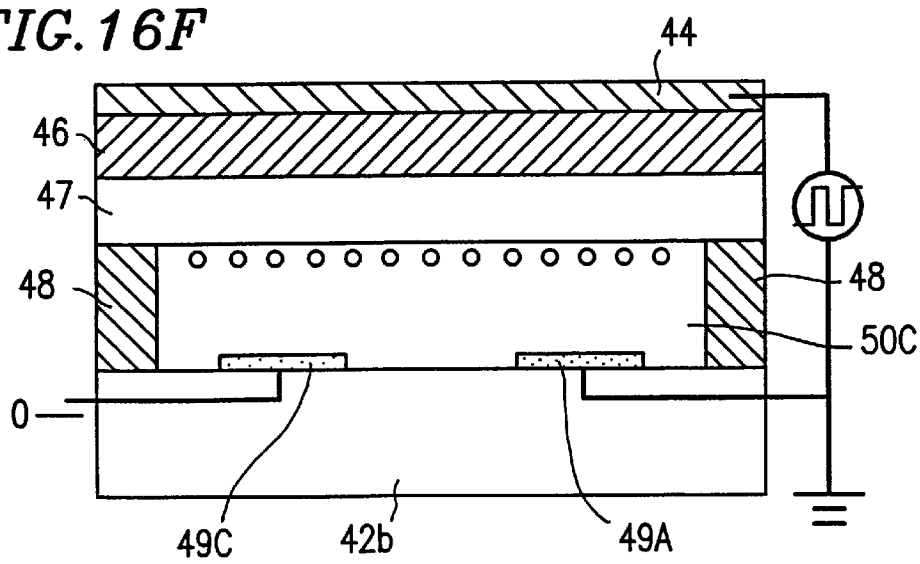
Figures 17A, 17B:
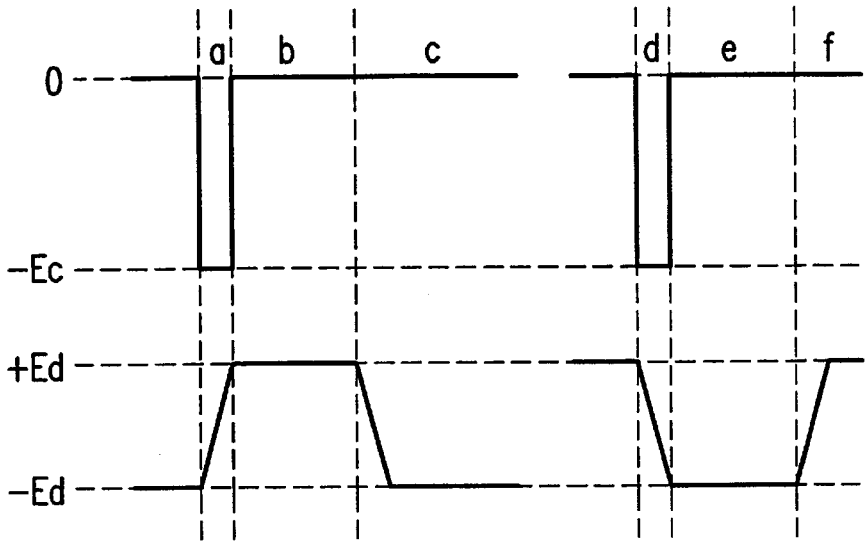
FIGS. 17A and 17B are diagrams illustrating the operation of the conventional plasma addressing display device.

In contrast, in the conventional plasma addressing display device 10 illustrated in FIG. 15, the width of the partition walls 48 is about 100 μm, with the distance between the centers of two adjacent partition walls 48 being about 700 μm, and the width of the electrode line (e.g., the anode 49A and the cathode 49C) is about 150 μm. Thus, the aperture ratio is about $[1-\{(150+50)\times2\}/700]\times100\approx43\%$.

Therefore, in the plasma addressing display device 100 of the present example, the aperture ratio is improved by about 14% from that of the conventional device 10.

In the present example, the electrode line (e.g., the anode 109A and the cathode 109C) of a metal such as Ni is formed directly on the transparent substrate 102*b* of a glass with a thickness of about 0.5 mm to about 3.0 mm. However, in order to improve the bonding property at the interface, an underlying layer of $SiO_2$, or the like, may be additionally provided therebetween.

The formation of the partition walls 108 and the electrode line (e.g., the anode 109A and the cathode 109C) may be performed by a printing process, a sand blasting process, or any other functionally similar processes.

The plasma addressing display device 100 of Example 1 provides an advantage that a driving method similar to conventional driving methods can be employed, while increasing the aperture ratio without detracting from the characteristics of the electrode line (e.g., the anode 109A and the cathode 109C).

EXAMPLE 2

Hereinafter, a plasma addressing display device 200 according to Example 2 of the present invention will be described with reference to FIG. 4.

Figure 4:
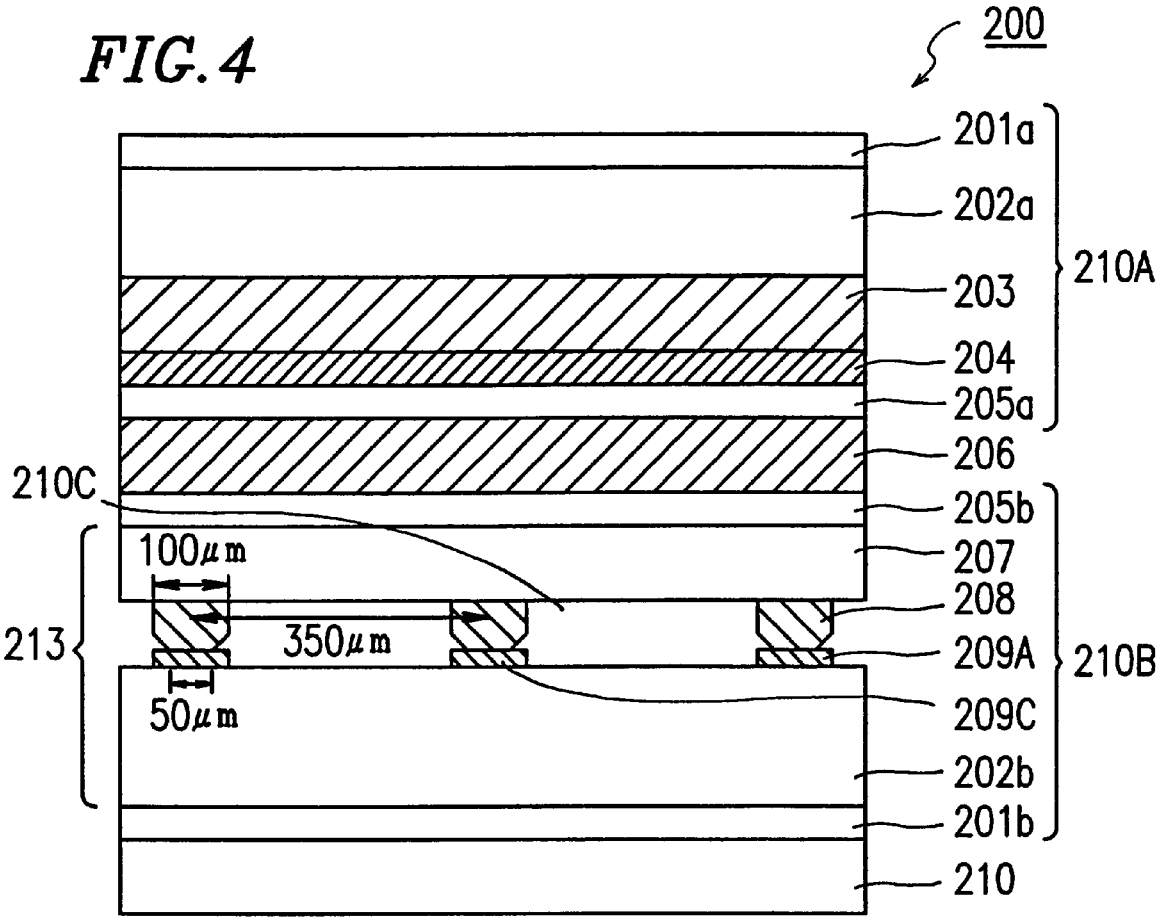
FIG. 4 is a cross-sectional view illustrating the plasma addressing display device according to Example 2 of the present invention.

FIG. 4 is a cross-sectional view illustrating the plasma addressing display device 200 according to Example 2 of the present invention. The positional relationship between a plasma discharge channel 210C and a transparent electrode line 204 of the device 200 of this example is as described above in Example 1 and illustrated in FIG. 2.

As illustrated in FIG. 4, the plasma addressing display device 200 includes a color filter substrate 210A and a plasma addressing substrate 210B on which a plasma addressing section 213 is formed, interposing a liquid crystal layer 206 which is provided by injecting a liquid crystal material therebetween. The display device 200 further includes a backlight 210 which is provided on the plasma addressing substrate 210B side of the display device 200.

The color filter substrate 210A includes: a polarizer 201*a*; a transparent substrate 202*a* formed of a glass with a thickness of about 0.5 mm to about 2.0 mm; a color filter 203; a transparent electrode line 204 formed of ITO, $SnO_2$, ITO+$SnO_2$, or the like; and an alignment film 205*a* formed of a polymer film. On the other hand, the plasma addressing substrate 210B in which the plasma addressing section 213 is formed includes: a polarizer 201*b*; a transparent substrate 202*b* formed of a glass with a thickness of about 0.5 mm to about 3.0 mm; a partition wall 208 formed of $SiO_2$, or the like; an electrode line (e.g., an anode 209A and a cathode 209C) formed of a metal such as Ni; a dielectric sheet 207 formed of a glass with a thickness of about 10 μm to 100 μm; and an alignment film 205*b* formed of a polymer film.

As illustrated in FIG. 4, according to the present example, the width of a portion of the partition walls 208 in the vicinity of the junction between the electrode line 209A or 209C and the partition walls 208 is about 50 μm, and the width of the other portion of the partition walls 208 is about 100 μm. The distance between the centers of two adjacent partition walls 208 is about 350 μm, and the width of the electrode line (e.g., the anode 209A and the cathode 209C) is about 100 μm. Thus, the aperture ratio is about $[1-\{(100/2)\times2\}/350]\times100\approx71\%$.

In contrast, in the conventional plasma addressing display device 10 illustrated in FIG. 15, the width of the partition wall 48 is about 100 μm, with the distance between the centers of two adjacent partition walls 48 being about 700 μm, and the width of the electrode line (e.g., the anode 49A and the cathode 49C) is about 150 μm. Thus, the aperture ratio is about $[1-\{(150+50)\times2\}/700]\times100\approx43\%$.

Therefore, in the plasma addressing display device 200 of the present example, the aperture ratio is improved by about 28% from that of the conventional device 10.

In the present example, the electrode line (e.g., the anode 209A and the cathode 209C) of a metal such as Ni is formed directly on the transparent substrate 202*b* of a glass with a thickness of about 0.5 mm to about 3.0 mm. However, in order to improve the bonding property at the interface, an underlying layer of $SiO_2$, or the like, may be additionally provided therebetween.

The formation of the partition walls 208 and the electrode line (e.g., the anode 209A and the cathode 209C) may be performed by a printing process, a sand blasting process, or any other functionally similar processes.

The operation principle of the plasma addressing section 213 of the present example is substantially the same as that of Example 1.

The plasma addressing display device 200 of Example 2 provides an advantage that a driving method similar to conventional driving methods can be employed, while increasing the aperture ratio without detracting from the characteristics of the electrode line (e.g., the anode 209A and the cathode 209C).

The partition wall in the plasma addressing display device 200 illustrated in FIG. 4 may be produced in the following manner.

First, an electrode material is printed on the transparent substrate 202*b* so as to form the electrode line (e.g., the anode 209A and the cathode 209C) with a width of about 100 μm. Then, an insulative material is printed on the electrode line (e.g., the anode 209A and the cathode 209C) so as to form a bottom portion of the partition wall 208 with a width less than that of the electrode line. This partition wall printing process is repeated for a number of iterations, while gradually increasing the width of the portion to be formed. For example, the width can be increased by 10 μm each time (i.e., about 50 μm for the first iteration, about 60 μm for the second iteration, about 70 μm for the third iteration, and so on), thereby printing a portion about 100 μm wide in the sixth iteration. After a portion is printed with substantially the same width as that of the electrode line (i.e., about 100 μm), the partition wall printing process is further repeated with a fixed width of about 100 μm until a desired thickness of the partition wall is obtained.

EXAMPLE 3

Hereinafter, a plasma addressing display device 300 according to Example 3 of the present invention will be described with reference to FIG. 5.

Figure 5:
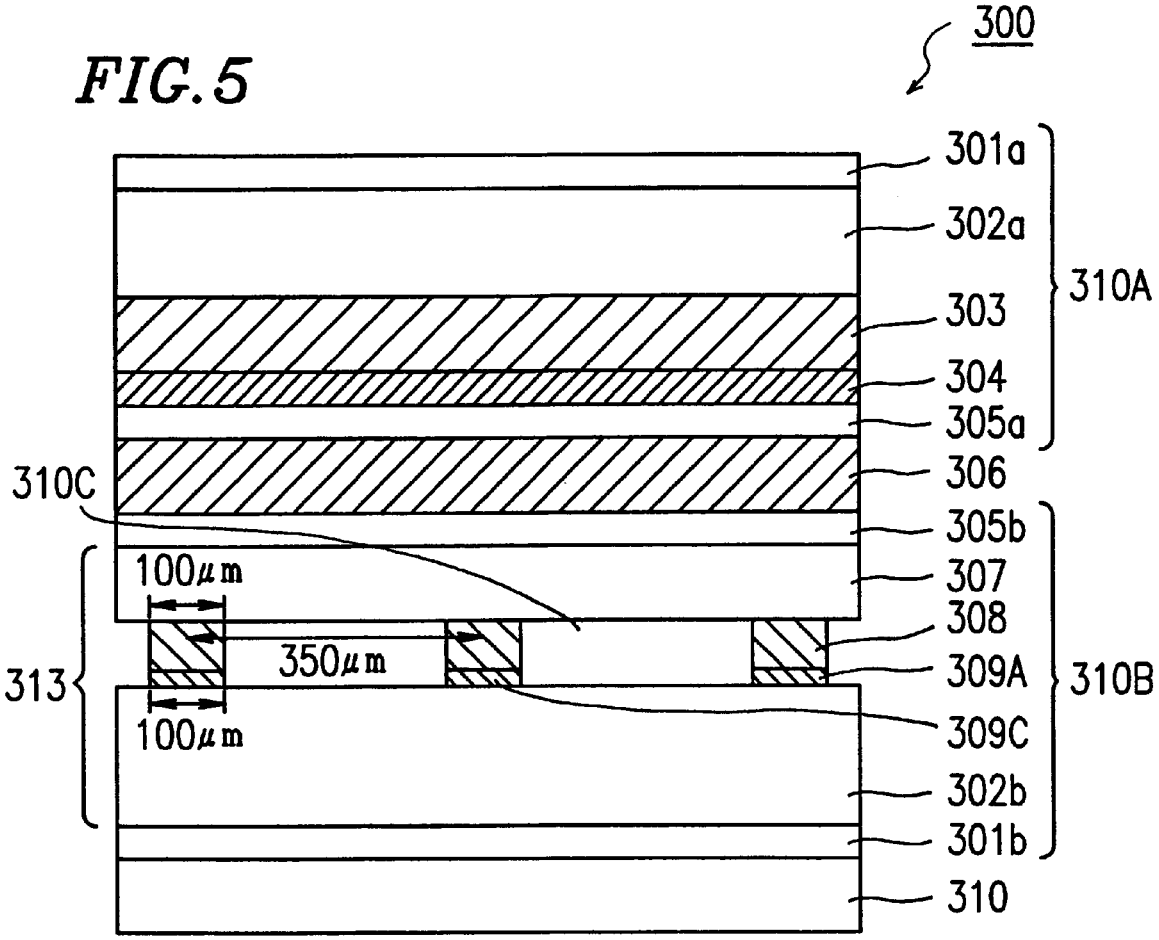
FIG. 5 is a cross-sectional view illustrating the plasma addressing display device according to Example 3 of the present invention.

FIG. 5 is a cross-sectional view illustrating the plasma addressing display device 300 according to Example 3 of the present invention. The positional relationship between a plasma discharge channel 310C and a transparent electrode line 304 of the device 300 of this example is as described above in Example 1 and illustrated in FIG. 2.

As illustrated in FIG. 5, the plasma addressing display device 300 includes a color filter substrate 310A and a plasma addressing substrate 310B on which a plasma addressing section 313 is formed, interposing a liquid crystal layer 306 which is provided by injecting a liquid crystal material therebetween. The display device 300 further includes a backlight 310 which is provided on the plasma addressing substrate 310B side of the display device 300.

The color filter substrate 310A includes: a polarizer 301*a*; a transparent substrate 302*a* formed of a glass with a thickness of about 0.5 mm to about 2.0 mm; a color filter 303; a transparent electrode line 304 formed of ITO, $SnO_2$, ITO+$SnO_2$, or the like; and an alignment film 305*a* formed of a polymer film. On the other hand, the plasma addressing substrate 310B in which the plasma addressing section 313 is formed includes: a polarizer 301*b*; a transparent substrate 302*b* formed of a glass with a thickness of about 0.5 mm to about 3.0 mm; the partition wall 308 formed of $SiO_2$, or the like; an electrode line (e.g., an anode 309A and a cathode 309C) formed of a metal such as Ni; a dielectric sheet 307 formed of a glass with a thickness of about 10 μm to 100 μm; and an alignment film 305*b* formed of a polymer film.

As illustrated in FIG. 5, according to the present example, the width of the partition wall 308 is about 100 μm, and the distance between the centers of two adjacent partition walls 308 is about 350 μm. Thus, the aperture ratio is about $[1-\{(100/2)\times 2\}/350]\times 100\approx 71\%$.

Hereinafter, a method for producing the plasma addressing display device 300 of this example will be described with reference to FIGS. 6A to 6E.

Figure 6A:
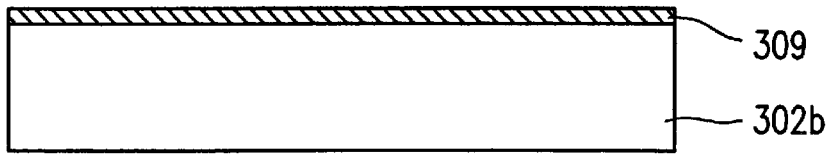
FIGS. 6A to 6E are cross-sectional views illustrating a method for producing the plasma addressing display device according to Example 3 of the present invention.

First, an electrode material layer 309 is formed on the transparent substrate 302*b*, as illustrated in FIG. 6A, by a printing process, or the like.

Figure 6B:
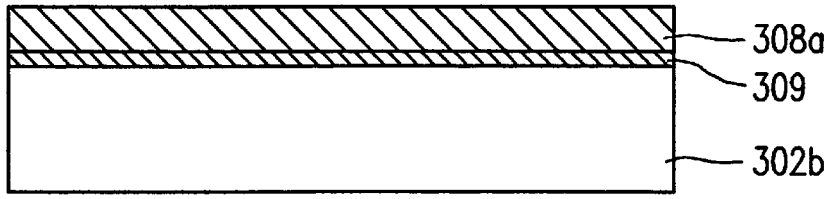

Then, an insulative material layer 308*a* is formed on the electrode material layer 309, as illustrated in FIG. 6B, by a printing process, or the like.

Figure 6C:
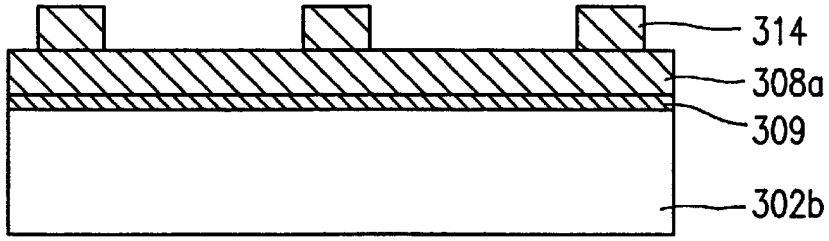
Figure 6D:
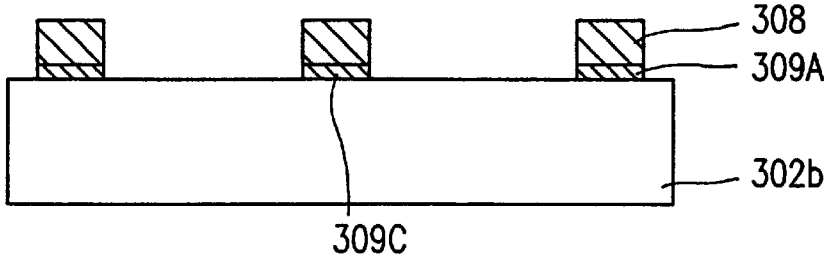

Then, a mask or a resist 314 is formed on the insulative material layer 308*a*, as illustrated in FIG. 6C. Successively, a physical etching process is performed so as to form the partition wall 308 and the electrode line (e.g., the anode 309A and the cathode 309C), as illustrated in FIG. 6D.

Figure 6E:
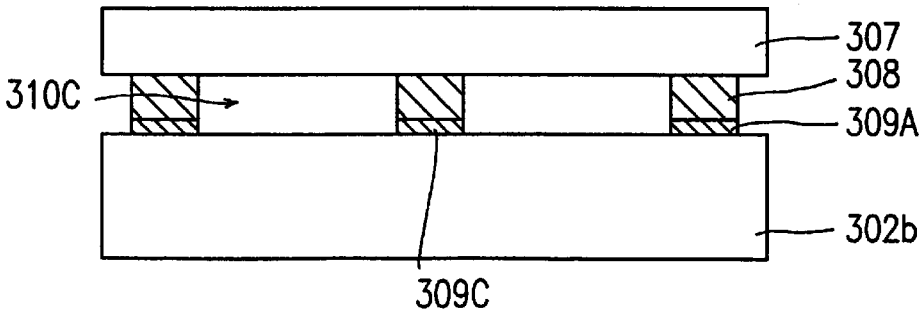

Finally, a dielectric sheet 307 is deposited on the partition walls 308, as illustrated in FIG. 6E, and then an inert gas is introduced into the plasma discharge channels 310C.

According to Example 3, a complicated printing technique is not required for forming the partition walls 308 and the electrode lines (e.g., the anode 309A and the cathode 309C). Moreover, since the electrode lines (e.g., the anode 309A and the cathode 309C) are buried in the partition walls 308 formed of an insulative material, there is only little change over time in the edges of the electrode lines (e.g., the anode 309A and the cathode 309C), thereby enhancing the reliability of the device.

The etching process employed in the above-described production may be a physical etching process such as a sand blasting process, a chemical etching process including a dry etching process such as those using hydrogen fluoride or hydrogen bromide and a wet etching process such as those using an aqueous solution of hydrogen fluoride, or any other appropriate processes.

The operation principle of the plasma addressing display device 300 of the present example is substantially the same as that of Example 1.

The structure and the production method of the plasma addressing display device 300 of Example 3 provides an advantage that a complicated printing technique is not required for forming the partition walls 308 while increasing the aperture ratio thereof.

EXAMPLE 4

Hereinafter, a plasma addressing display device 400 according to Example 4 of the present invention will be described with reference to FIGS. 7 and 8A to 8F.

Figure 7:
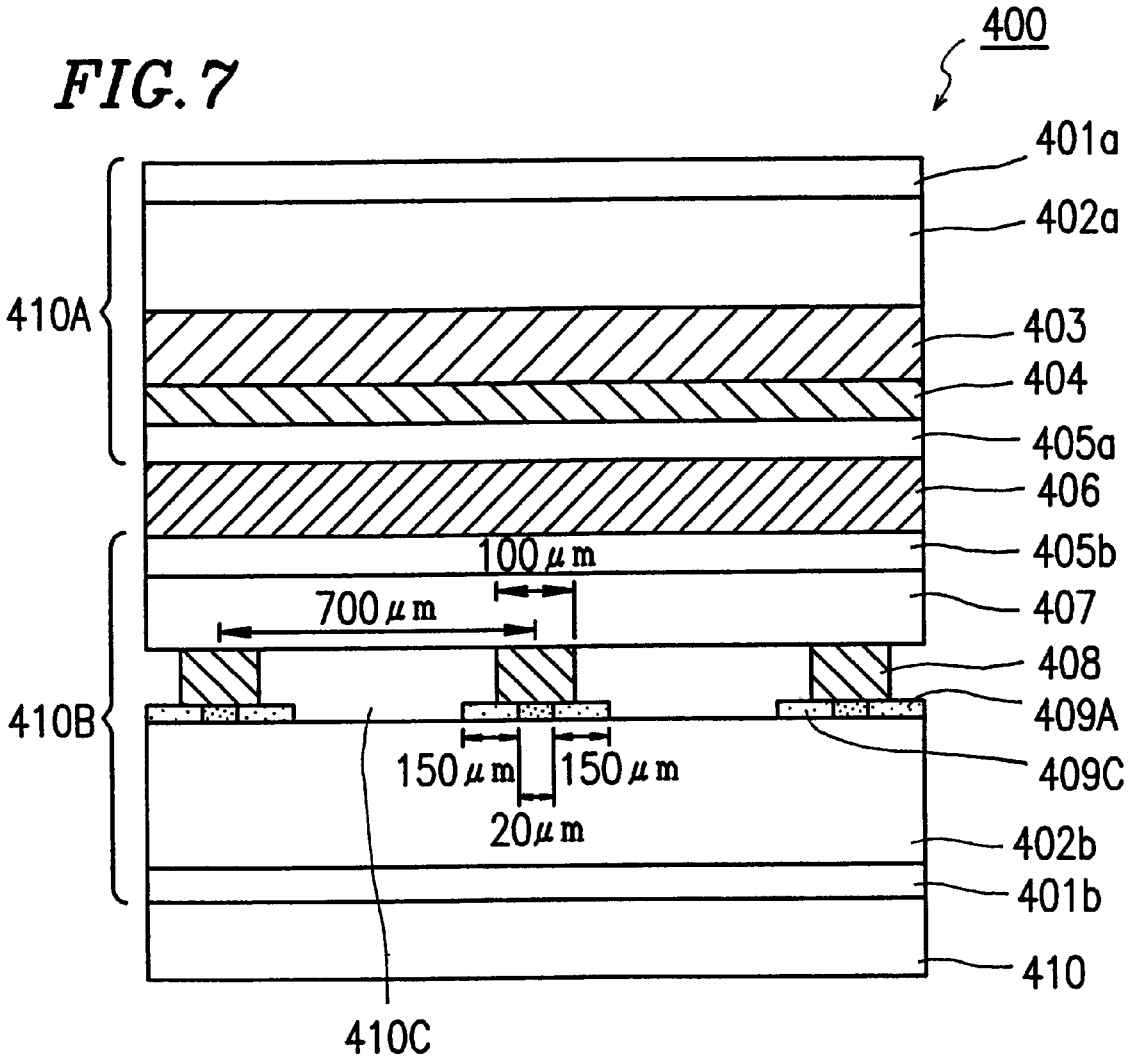
FIG. 7 is a cross-sectional view illustrating the plasma addressing display device according to Example 4 of the present invention.

As illustrated in FIG. 7, the plasma addressing display device 400 includes a color filter substrate 410A and a plasma addressing substrate 410B, interposing a liquid crystal layer 406 which is provided by injecting a liquid crystal material therebetween. The display device 400 further includes a backlight 410 which is provided on the plasma addressing substrate 410B side of the display device 400.

The color filter substrate 410A includes: a polarizer 401*a*; a transparent substrate 402*a* formed of a glass with a thickness of about 0.5 mm to about 2.0 mm; a color filter 403; a transparent electrode line 404 formed of ITO, $SnO_2$, ITO+$SnO_2$, or the like; and an alignment film 405*a* formed of a polymer film. On the other hand, the plasma addressing substrate 410B includes: a polarizer 401*b*; a transparent substrate 402*b* formed of a glass with a thickness of about 0.5 mm to about 3.0 mm; a partition wall 408 formed of $SiO_2$, or the like; an electrode line (e.g., an anode 409A and a cathode 409C) formed of a metal such as Ni; a dielectric sheet 407 formed of a glass with a thickness of about 10 μm to 100 μm; and an alignment film 405*b* formed of a polymer film.

In the plasma addressing substrate 410B, two electrode lines (e.g., the anode 409A and the cathode 409C) of a metal such as Ni are formed on the transparent substrate 402*b* so as to be spaced apart from each other, on which the partition wall 408 of $SiO_2$, or the like, is formed. Thus, the anode 409A and the cathode 409C are insulated from each other by a portion of the partition wall 408.

The plasma addressing substrate 410B includes a plurality of plasma discharge channels 410C each being a space enclosed by the transparent substrate 402*b*, two adjacent partition walls 408 and the dielectric sheet 407. The plasma discharge channels 410C each contain a noble gas, such as He, Ne, Ar and Xe, at a gas pressure of about 10 Pa to about $10^4$ Pa, preferably about $10^2$ Pa to about $5\times10^3$ Pa. The transparent electrode line is linearly arranged so that the transparent electrode line 404 orthogonally crosses over the plasma discharge channel 410C, which is also linearly arranged but in a different direction. Each region where the transparent electrode line 404 and the plasma discharge channel 410C overlap each other corresponds to a picture element of the color filter 403.

As will be described later in more detail with reference to FIG. 12, the linearly arranged transparent electrode line 404 is in the "skew relationship" with respect to the plasma discharge channel 410C, which is also linearly arranged but in a different direction. Each region where the transparent electrode line 404 and the plasma discharge channel 410C overlap each other corresponds to a picture element of the color filter 403.

Herein, it is note that a portion of the partition wall 408 which insulates the anode 409A and the cathode 409C from each other can be formed separately from the formation of the other portion of the partition wall 408. For example, it is possible to first form the portion insulating the anode 409A and the cathode 409C from each other, and to then form the other portion of the partition wall 408. In such a case, it is assumed to form both portions on the transparent substrate 402*b* side. However, it is also possible, for example, to form on the transparent substrate 402*b* only the portion insulating the anode 409A and the cathode 409C from each other, while forming the other portion on the dielectric sheet 407 side, subsequently attaching the portions together to provide the partition wall.

Hereinafter, the operation of the plasma addressing substrate 410B will be briefly described with reference to FIGS. 8A to 8F.

Writing and holding of information are performed in the following manner.

Figure 8A:
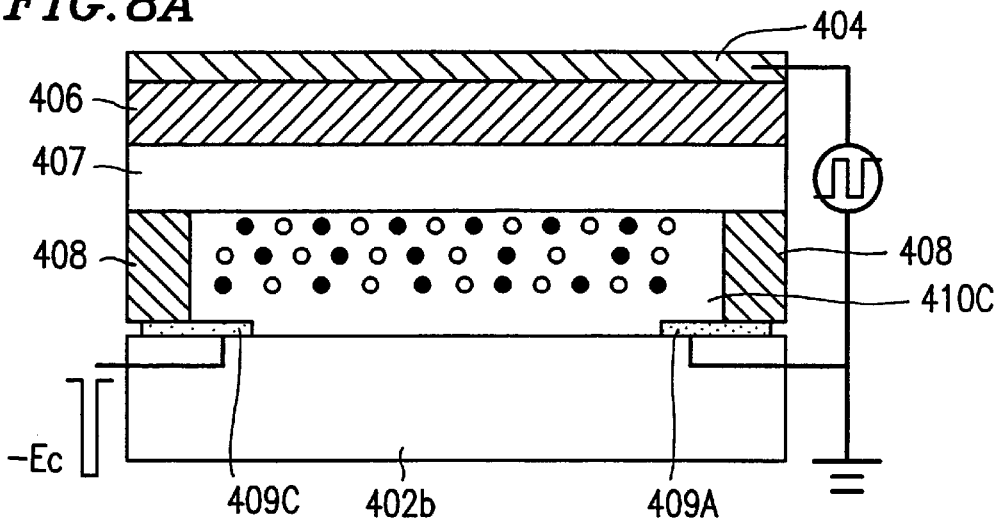
FIGS. 8A to 8F are cross-sectional views illustrating the operation of the plasma addressing display device according to Example 4 of the present invention.

First, as illustrated in FIG. 8A, a voltage of about 100 V to about 500 V is applied between the anode 409A and the cathode 409C, i.e., a voltage Ec of about −300 V to about −450 V is applied to the cathode 409C, thereby causing an electric discharge.

Figure 8B:
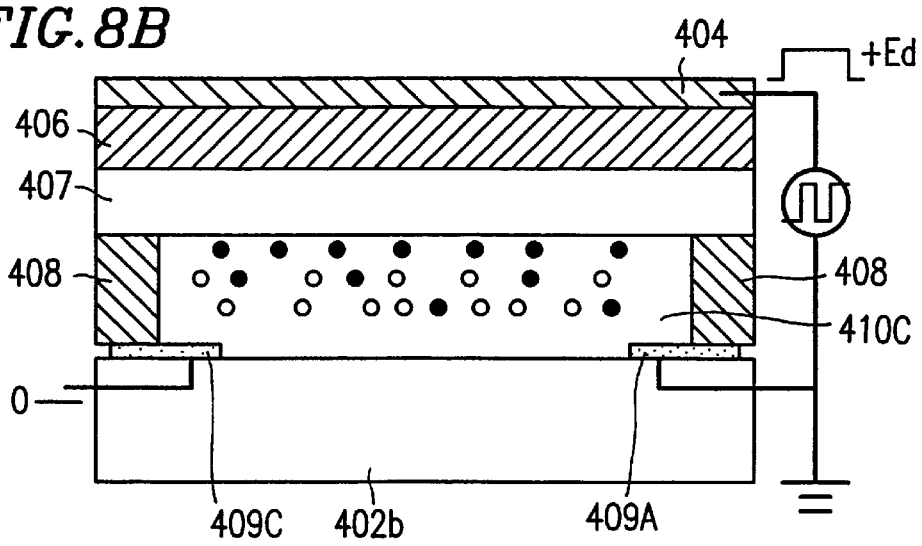
Figure 8C:
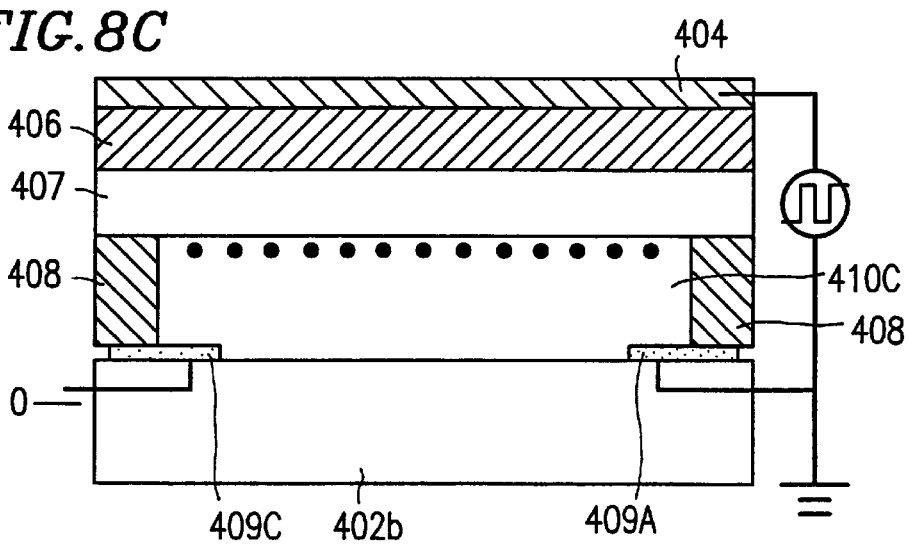

Then, a voltage Ed of about +50 V to about +100 V is applied to the transparent electrode line 404 of the color filter substrate 410A, as illustrated in FIG. 8B, thereby writing information, and then the electric discharge is discontinued so as to negatively charge the dielectric sheet 407 interface, as illustrated in FIG. 8C, thereby holding the written information.

Figure 8D:
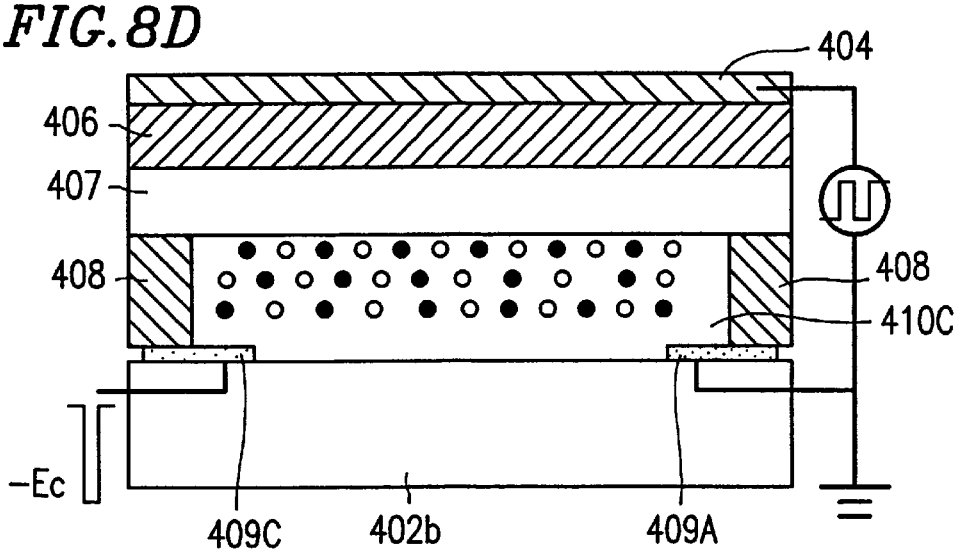
Figure 8E:
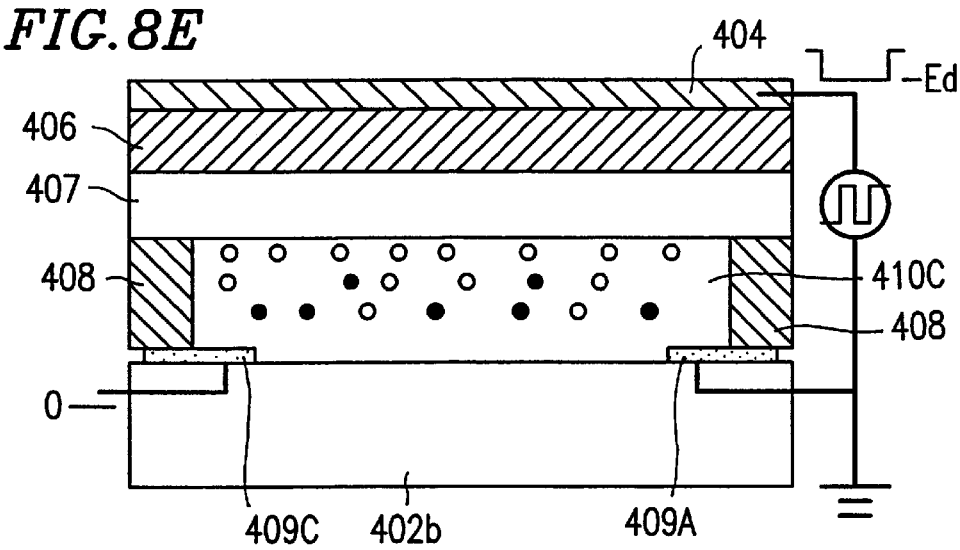
Figure 8F:
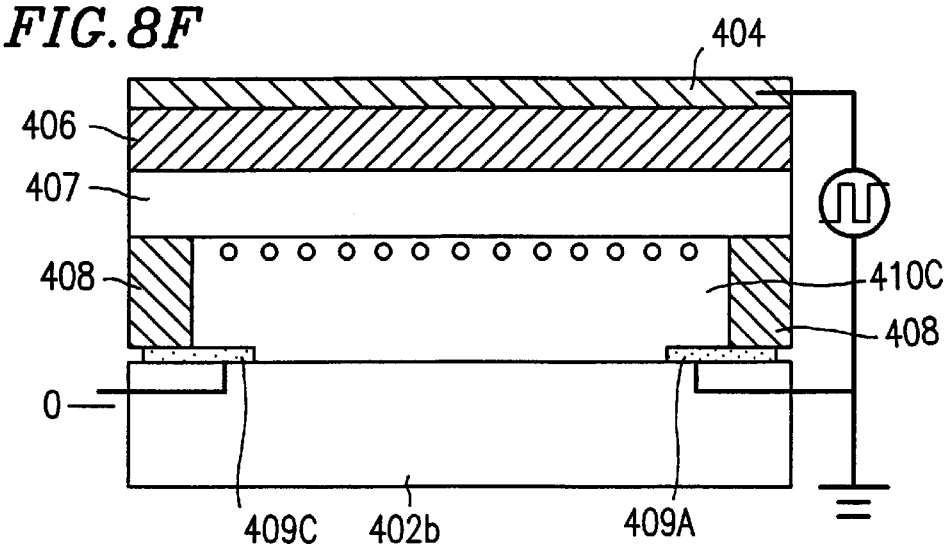

On the other hand, the dielectric sheet 407 interface may also be positively charged in a manner illustrated in FIGS. 8D to 8F. First, a voltage Ed of about −50 V to about −100 V is applied to the transparent electrode line 404 of the color filter substrate 410A. In practice, an alternating voltage switching between about 0 V and about +50 V to about +100 V is applied to the anode 409A in order to prevent a DC component from being superimposed on the liquid crystal layer.

As illustrated in FIG. 7, according to the present example, the width of the partition wall 408 is about 100 μm, and the distance between the centers of two adjacent partition walls 408 is about 700 μm. The width of the electrode line is about 150 μm, and the distance between two adjacent electrode lines (e.g., the anode 409A and the cathode 409C) is about 20 μm. Thus, the aperture ratio is about $[1-\{(150+20/2)\times 2\}/700]\times100\approx54\%$.

In contrast, in the conventional plasma addressing display device 10 illustrated in FIG. 15, the width of the partition walls 48 is about 100 μm, with the distance between the centers of two adjacent partition walls 48 being about 700 μm, and the width of the electrode line (e.g., the anode 49A and the cathode 49C) is about 150 μm. Thus, the aperture ratio is about $[1-\{(150+50)\times2\}/700]\times100\approx43\%$.

Therefore, in the plasma addressing display device 400 of the present example, the aperture ratio is improved by about 11% from that of the conventional device 10.

According to the present example, the width of the effective portion of the electrode line which is involved in causing an electric discharge has been reduced from about 150 μm (as in the conventional device 10) to about 110 μm. However, such a reduction would not adversely affect the electric discharge generation.

In the present example, the electrode line (e.g., the anode 409A and the cathode 409C) of a metal such as Ni is formed directly on the transparent substrate 402*b* of a glass with a thickness of about 0.5 mm to about 3.0 mm. However, in order to improve the bonding property at the interface, an underlying layer of $SiO_2$, or the like, may be additionally provided therebetween.

The formation of the partition walls 408 and the electrode line (e.g., the anode 409A and the cathode 409C) may be performed by a printing process, a sand blasting process, or any other functionally similar processes.

The plasma addressing display device 400 of Example 4 provides an advantage that the aperture ratio of the device is increased.

EXAMPLE 5

Hereinafter, a plasma addressing display device 500 according to Example 5 of the present invention will be described with reference to FIGS. 9 and 10A to 10F.

Figure 9:
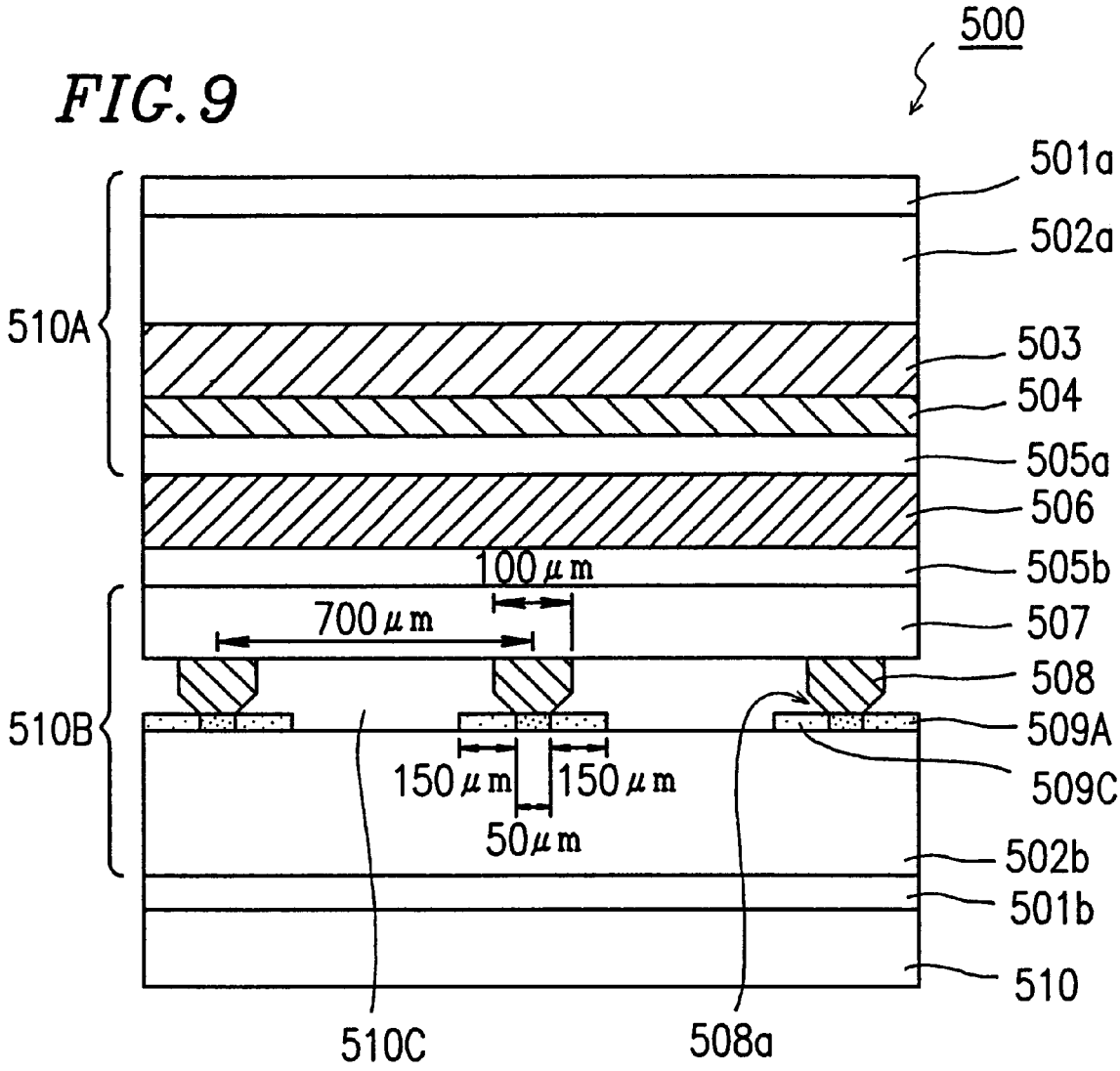
FIG. 9 is a cross-sectional view illustrating the plasma addressing display device according to Example 5 of the present invention.

As illustrated in FIG. 9, the plasma addressing display device 500 includes a color filter substrate 510A and a plasma addressing substrate 510B, interposing a liquid crystal layer 506 which is provided by injecting a liquid crystal material therebetween. The display device 500 further includes a backlight 510 which is provided on the plasma addressing substrate 510B side of the display device 500.

The color filter substrate 510A includes: a polarizer 501*a*; a transparent substrate 502*a* formed of a glass with a thickness of about 0.5 mm to about 2.0 mm; a color filter 503; a transparent electrode line 504 formed of ITO, $SnO_2$, ITO+$SnO_2$, or the like; and an alignment film 505*a* formed of a polymer film. On the other hand, the plasma addressing substrate 510B includes: a polarizer 501*b*; a transparent substrate 502*b* formed of a glass with a thickness of about 0.5 mm to about 3.0 mm; a partition wall 508 formed of $SiO_2$, or the like; an electrode line (e.g., an anode 509A and a cathode 509C) formed of a metal such as Ni; a dielectric sheet 507 formed of a glass with a thickness of about 10 μm to 100 μm; and an alignment film 505*b* formed of a polymer film.

In the plasma addressing substrate 510B, two electrode lines (e.g., the anode 509A and the cathode 509C) of a metal such as Ni are formed on the transparent substrate 502*b* so as to be spaced apart from each other, on which the partition wall 508 of $SiO_2$, or the like, is formed.

The formation is performed in the following manner.

First, the bottom portion of the partition wall 508 is formed which will insulate the anode 509A and the cathode 509C from each other. Then, the intermediate portion of the partition wall 508 which includes a notch 508*a* is formed by iteratively forming a portion of the partition wall 508 on the bottom portion while gradually increasing the width of the portion to be formed over the iterations. Finally, the upper portion of the partition wall 508 having a constant width is formed.

For example, in order to have a narrow portion of the partition wall 508 in the vicinity of the junction between the transparent substrate 502*b* and the partition wall 508, the electrode lines each having a width of about 150 μm are formed so as to have a gap of about 50 μm between two adjacent electrode lines, with the distance between the outer edges of the two adjacent electrode lines being about 350 μm. Then, the bottom portion of the partition wall is formed with a corresponding width of about 50 μm in the gap between the two adjacent electrode lines by a screening printing process. Successively, the printing process is repeated for a number of iterations to form portions of the partition wall on the bottom portion with successively increasing widths, e.g., about 50 μm, about 70 μm, about 90 μm and finally about 100 μm. The remaining portion of the partition wall is then formed to have a constant width of about 100 μm. Thereafter, the formed partition wall is pre-baked and then baked, thereby obtaining the partition wall 508.

The portion of the partition wall 508 which insulates the anode 509A and the cathode 509C from each other and the other portion may be formed respectively on different substrates. For example, it is possible to form the portion of the partition wall 508 which insulates the anode 509A and the cathode 509C from each other on the transparent substrate 502*b*, while forming the other portion thereof on the dielectric sheet 507, subsequently aligning the partition wall portions with respect to each other and attaching the partition wall portions together.

The plasma addressing channel 510C is enclosed by the transparent substrate 502*b*, two adjacent partition walls 508 and the dielectric sheet 507 and contains a noble gas, such as He, Ne, Ar and Xe, at a gas pressure of about 10 Pa to about $10^4$ Pa, preferably about $10^2$ Pa to about $5\times10^3$ Pa.

As will be described later in more detail with reference to FIG. 12, the linearly arranged transparent electrode line 504 is in the "skew relationship" with respect to the plasma discharge channel 510C, which is also linearly arranged but in a different direction. Each region where the transparent electrode line 504 and the plasma discharge channel 510C overlap each other corresponds to a picture element of the color filter 503.

Hereinafter, the operation of the plasma addressing substrate 510B will be briefly described with reference to FIGS. 10A to 10F.

Writing and holding of information are performed in the following manner.

Figure 10A:
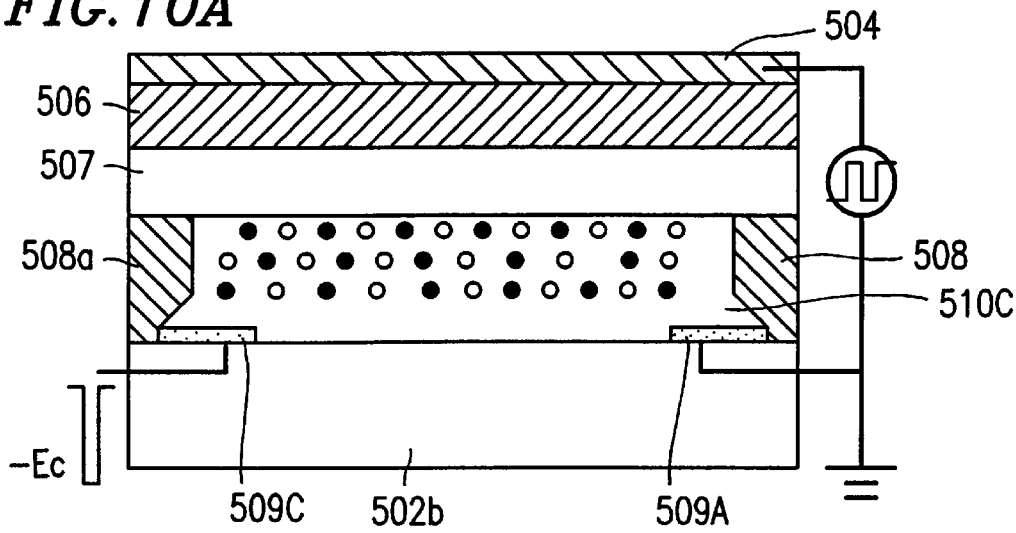
FIGS. 10A to 10F are cross-sectional views illustrating the operation of the plasma addressing display device according to Example 5 of the present invention.

First, as illustrated in FIG. 10A, a voltage of about 100 V to about 500 V is applied between the anode 509A and the cathode 509C, i.e., a voltage Ec of about −300 V to about −450 V is applied to the cathode 509C, thereby causing an electric discharge.

Figure 10B:
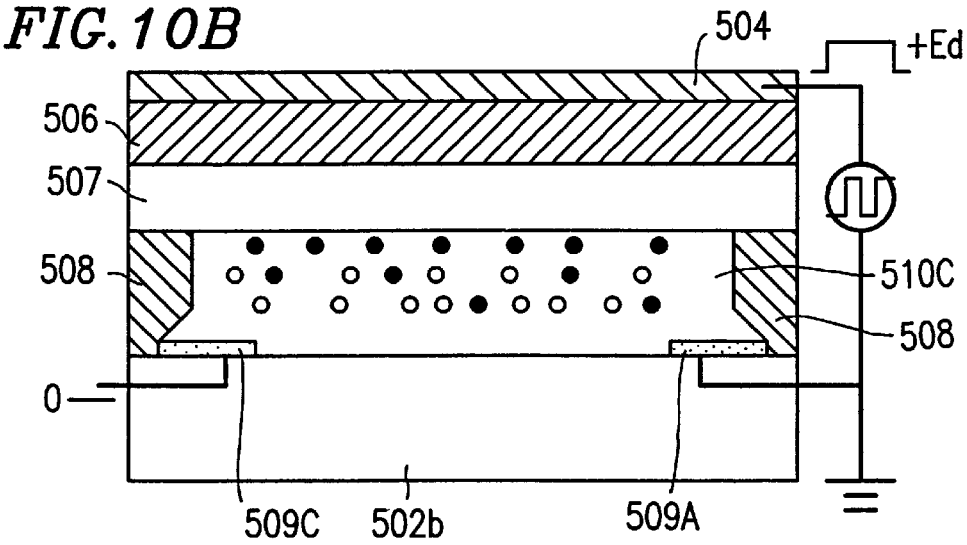
Figure 10C:
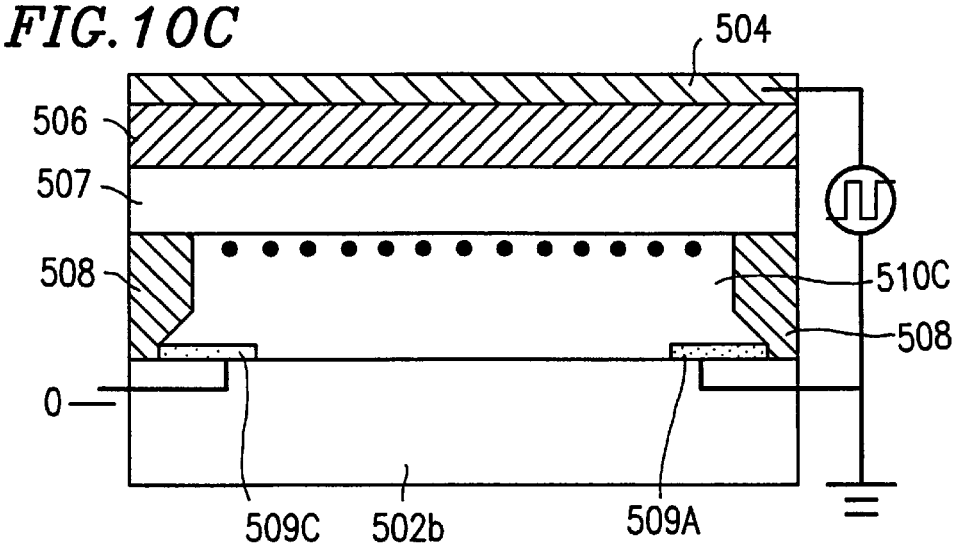

Then, a voltage Ed of about +50 V to about +100 V is applied to the transparent electrode line 504 of the color filter substrate 510A, as illustrated in FIG. 10B, thereby writing information, and then the electric discharge is discontinued so as to negatively charge the dielectric sheet 507 interface, as illustrated in FIG. 10C, thereby holding the written information.

Figure 10D:
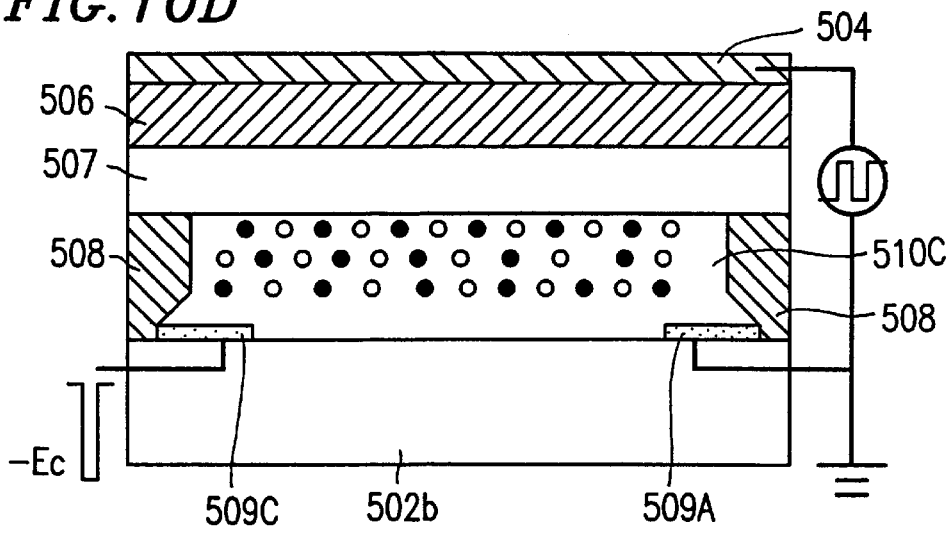
Figure 10E:
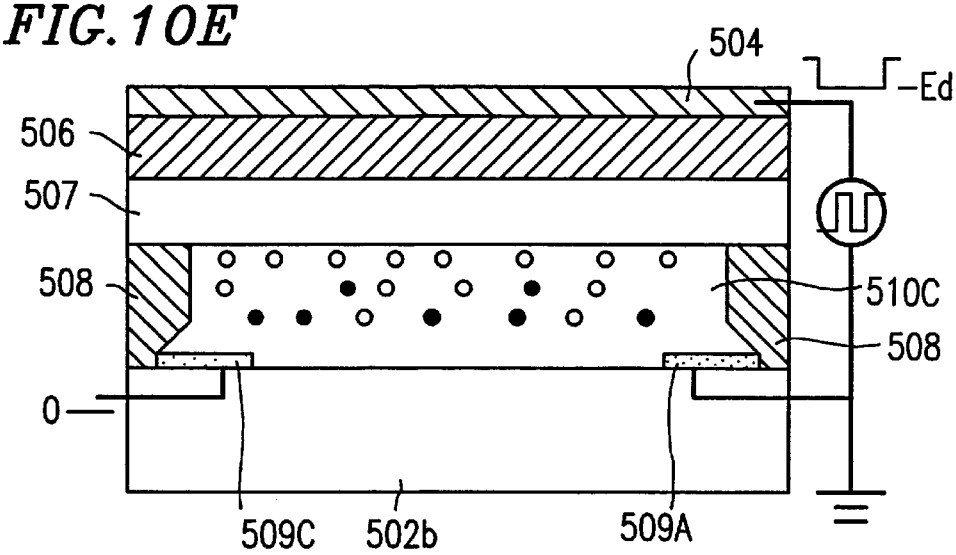
Figure 10F:
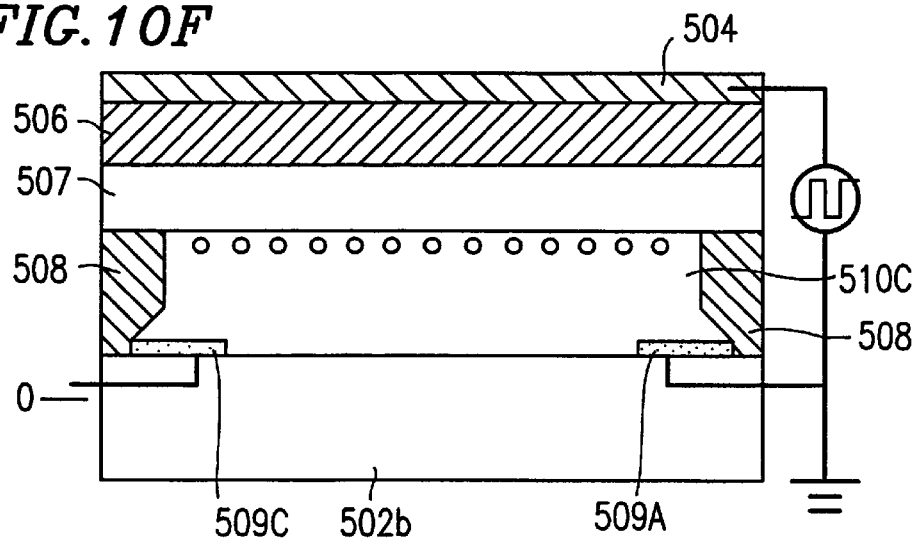

On the other hand, the dielectric sheet 507 interface may also be positively charged in a manner illustrated in FIGS. 10D to 10F. First, a voltage Ed of about −50 V to about −100 V is applied to the transparent electrode line 504 of the color filter substrate 510A. In practice, an alternating voltage switching between about 0 V and about +50 V to about +100 V is applied to the anode 509A in order to prevent a DC component from being superimposed on the liquid crystal layer.

As illustrated in FIG. 9, according to the present example, the width of a portion of the partition walls 508 in the vicinity of the junction between the transparent substrate 502*b* and the partition walls 508 is about 50 μm, and the width of the other portion of the partition walls 508 is about 100 μm. The distance between the centers of two adjacent partition walls 508 is about 700 μm, and the width of the electrode line (e.g., the anode 509A and the cathode 509C) is about 150 μm, with the distance between two adjacent electrode lines being about 50 μm. Thus, the aperture ratio is about $[1-\{(150+50/2)\times2\}/700]\times100\approx50\%$. This is an about 7% improvement from the aperture ratio of the conventional plasma addressing display device 10, that is about $[1-\{(150+50)\times2\}/700]\times100\approx43\%$.

In the present example, the electrode line (e.g., the anode 509A and the cathode 509C) of a metal such as Ni is formed directly on the transparent substrate 502*b* of a glass with a thickness of about 0.5 mm to about 3.0 mm. However, in order to improve the bonding property at the interface, an underlying layer of $SiO_2$, or the like, may be additionally provided therebetween.

The formation of the partition walls 508 and the electrode line (e.g., the anode 509A and the cathode 509C) may be performed by a printing process, a sand blasting process, or any other functionally similar processes.

The plasma addressing display device 500 of Example 5 provides an advantage that the aperture ratio of the device is increased without detracting from the characteristics of the electrode line (e.g., the anode 509A and the cathode 509C).

EXAMPLE 6

Hereinafter, a plasma addressing display device 600 according to Example 6 of the present invention will be described with reference to FIGS. 11, 12 and 13A to 13F.

Figure 11:
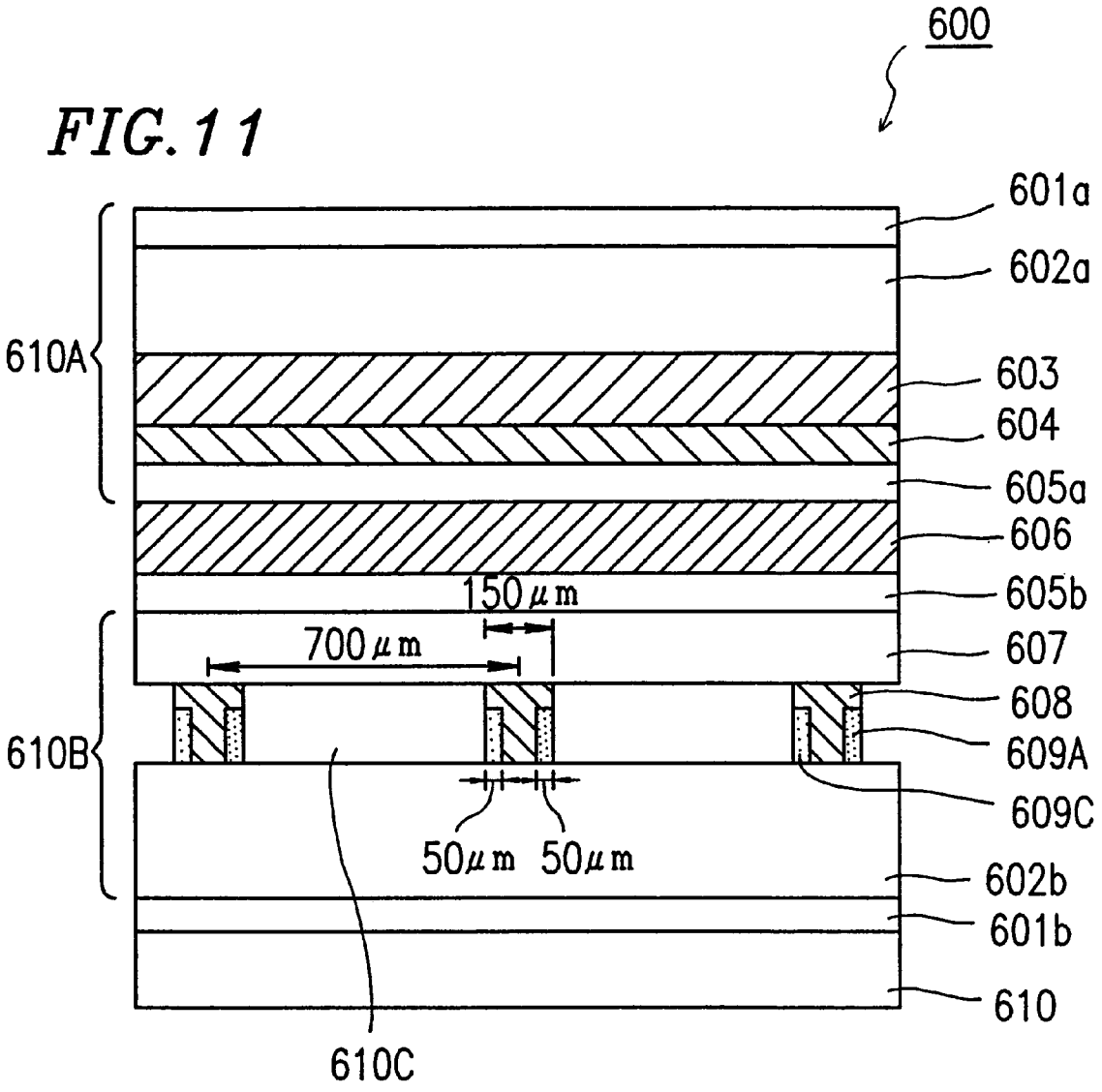
FIG. 11 is a cross-sectional view illustrating the plasma addressing display device according to Example 6 of the present invention.

As illustrated in FIG. 11, the plasma addressing display device 600 includes a color filter substrate 610A and a plasma addressing substrate 610B, interposing a liquid crystal layer 606 which is provided by injecting a liquid crystal material therebetween. The display device 600 further includes a backlight 610 which is provided on the plasma addressing substrate 610B side of the display device 600.

The color filter substrate 610A includes: a polarizer 601*a*; a transparent substrate 602*a* formed of a glass with a thickness of about 0.5 mm to about 2.0 mm; a color filter 603; a transparent electrode line 604 formed of ITO, $SnO_2$, ITO+$SnO_2$, or the like; and an alignment film 605*a* formed of a polymer film. On the other hand, the plasma addressing substrate 610B includes: a polarizer 601*b*; a transparent substrate 602*b* formed of a glass with a thickness of about 0.5 mm to about 3.0 mm; a partition wall 608 formed of $SiO_2$, or the like; an electrode line (e.g., an anode 609A and a cathode 609C) formed of a metal such as Ni; a dielectric sheet 607 formed of a glass with a thickness of about 10 $\mu$m to 100 $\mu$m; and an alignment film 605*b* formed of a polymer film. The anode 609A and the cathode 609C are both entirely buried in the partition wall 608.

The plasma addressing substrate 610B includes a plurality of the plasma discharge channels 610C each being a space enclosed by the transparent substrate 602*b*, two adjacent partition walls 608 and the dielectric sheet 607. The plasma discharge channels 610C each contain a noble gas, such as He, Ne, Ar and Xe, at a gas pressure of about 10 Pa to about $10^4$ Pa, preferably about $10^2$ Pa to about $5\times10^3$ Pa.

Figure 12:
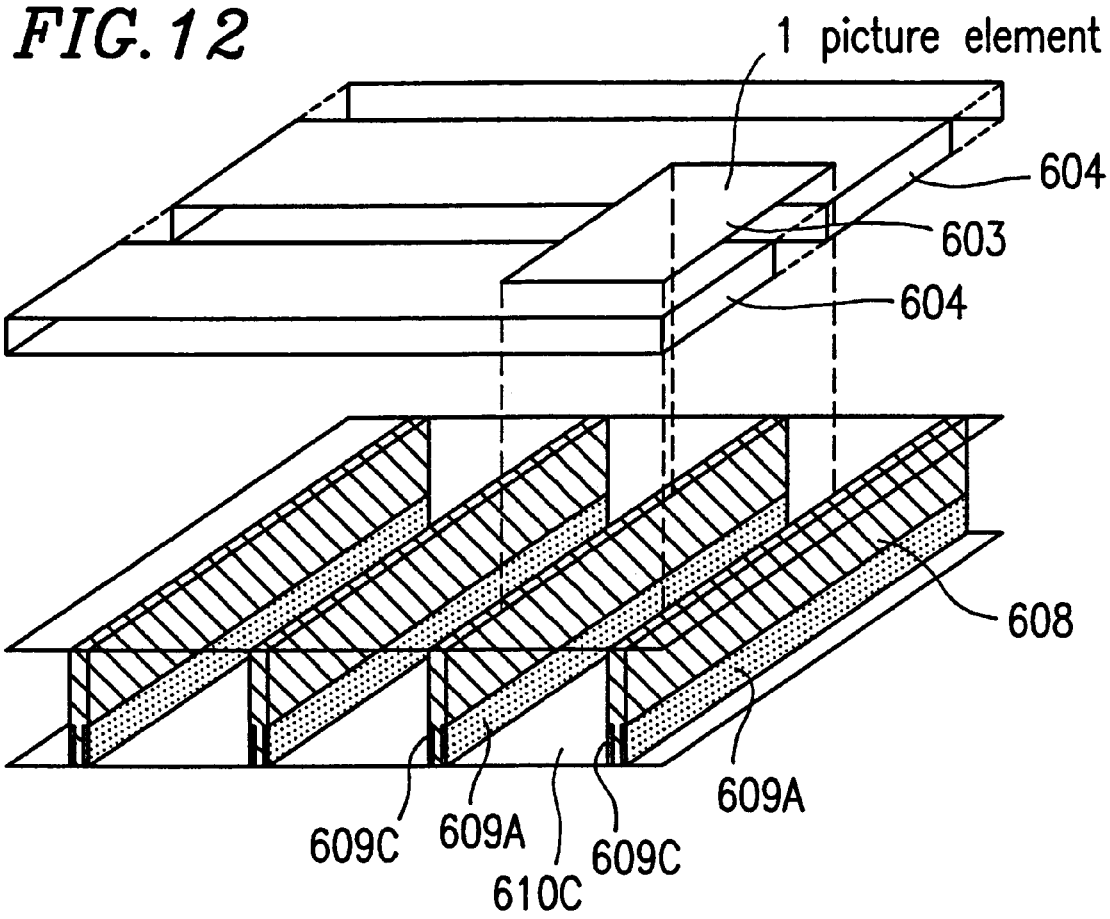
FIG. 12 is an exploded perspective view for illustrating the positional relationship between a plasma addressing channel and a transparent electrode line in the plasma addressing display device according to Example 6 of the present invention.

As illustrated in FIG. 12, the linearly arranged transparent electrode line 604 is in the "skew relationship" with respect to the plasma discharge channel 610C, which is also linearly arranged but in a different direction. Each region where the transparent electrode line 604 and the plasma discharge channel 610C overlap each other corresponds to a picture element of the color filter 603. This relationship is also true in the Examples 4 and 5 above.

According to the present example, the electrode lines (e.g., an anode 609A and a cathode 609C) are buried in the partition wall 608. Thus, with the width of the partition walls 608 being about 150 $\mu$m, and the distance between the centers of two adjacent partition walls 608 being about 700 $\mu$m, the aperture ratio is still as great as about $[1-\{(150/2)\times2\}/700]\times100\approx79\%$. This is an about 35% improvement from the aperture ratio of the conventional plasma addressing display device 10, that is about $[1-\{(150+50)\times2\}/700]\times100\approx43\%$.

Moreover, since the electrode lines (e.g., the anode 609A and the cathode 609C) are buried on respective sides of the partition wall 608, while opposing each other in parallel, it is possible to realize a uniform electric discharge with a low discharge voltage.

Furthermore, since the width of the electrode line (e.g., the anode 609A and the cathode 609C) does not have to be accounted for, the distance between the centers of two adjacent partition walls 608 can be accordingly shortened, whereby it is possible to realize a higher definition display.

In the present example, the electrode line (e.g., the anode 609A and the cathode 609C) of a metal such as Ni is formed directly on the transparent substrate 602*b* of a glass with a thickness of about 0.5 mm to about 3.0 mm. However, in order to improve the bonding property at the interface, an underlying layer of $SiO_2$, or the like, may be additionally provided therebetween.

The formation of the partition walls 608 and the electrode line (e.g., the anode 609A and the cathode 609C) may be performed by a printing process, a sand blasting process, or any other functionally similar processes.

Hereinafter, the operation principle of the plasma addressing substrate 610B of the present example will be briefly described with reference to FIGS. 13A to 13F.

Writing and holding of information are performed in the following manner.

Figure 13A:
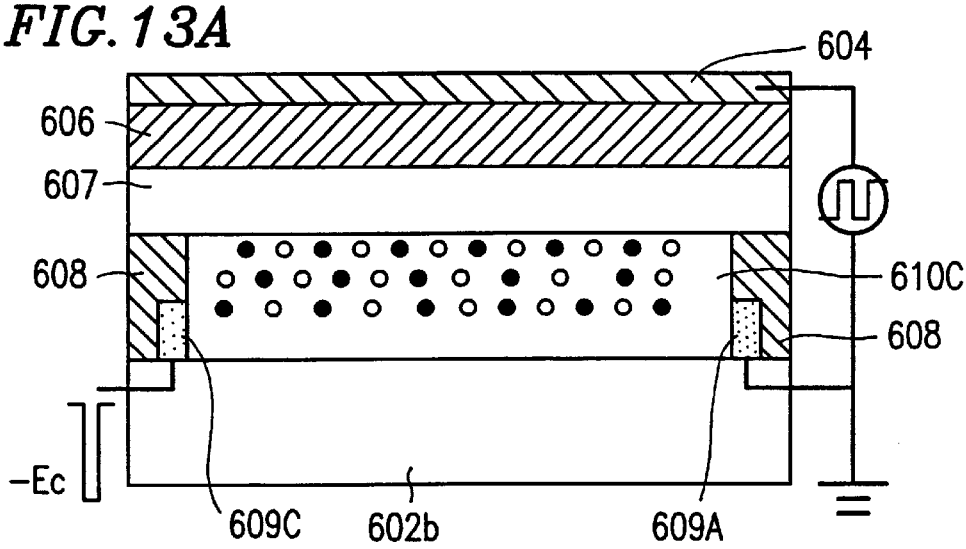
FIGS. 13A to 13F are cross-sectional views illustrating the operation of the plasma addressing display device according to Example 6 of the present invention.

First, as illustrated in FIG. 13A, a voltage of about 100 V to about 500 V is applied between the anode 609A and the cathode 609C, i.e., a voltage Ec of about −300 V to about −450 V is applied to the cathode 609C, thereby causing an electric discharge.

Figure 13B:
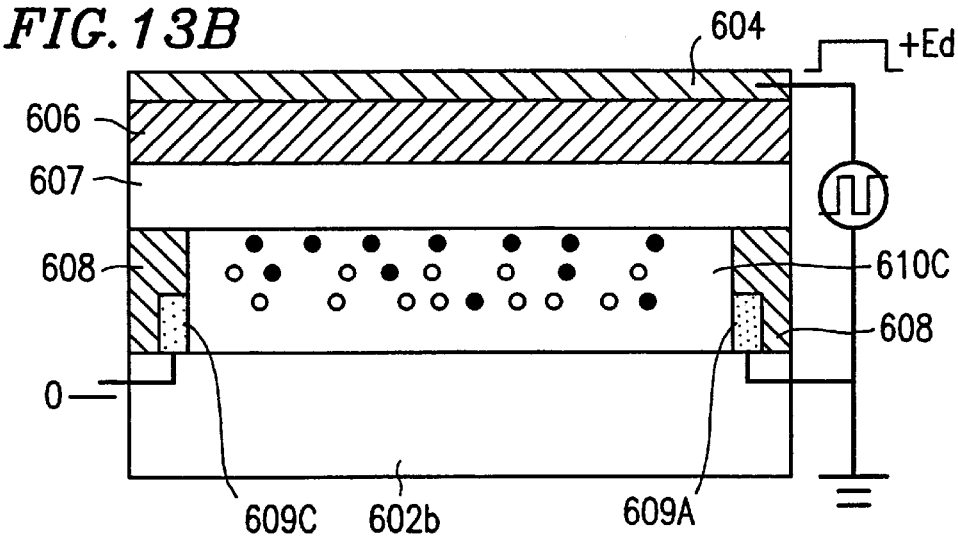
Figure 13C:
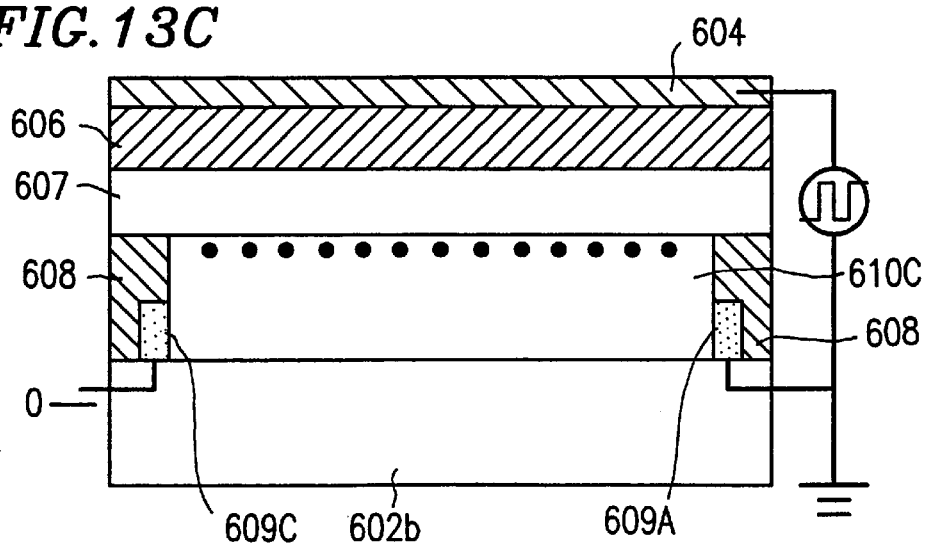

Then, a voltage Ed of about +50 V to about +100 V is applied to the transparent electrode line 604 of the color filter substrate 610A, as illustrated in FIG. 13B, thereby writing information, and then the electric discharge is discontinued so as to negatively charge the dielectric sheet 607 interface, as illustrated in FIG. 13C, thereby holding the written information.

Figure 13D:
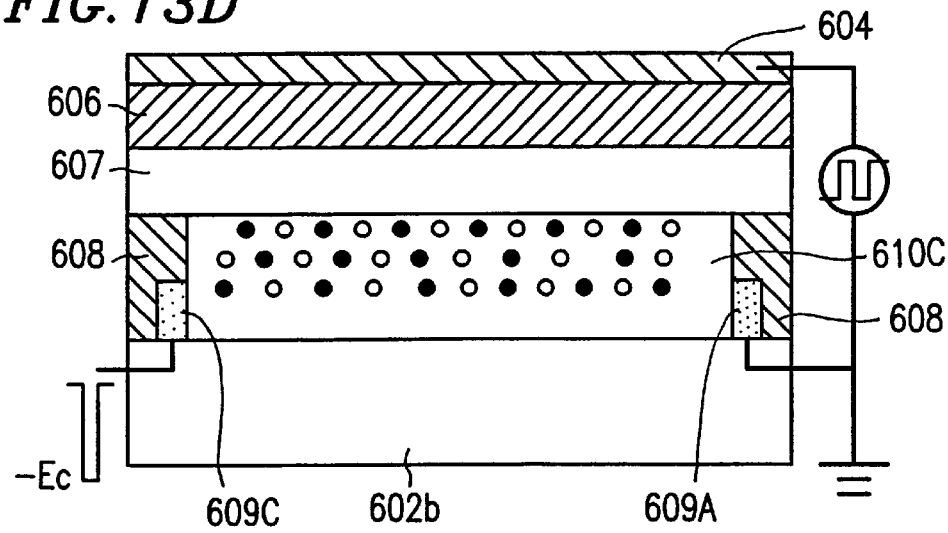
Figure 13E:
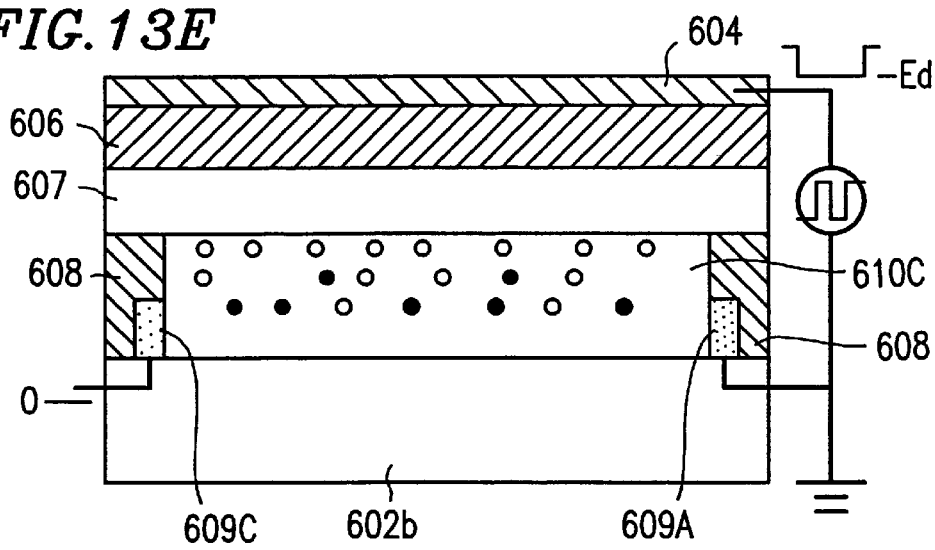
Figure 13F:
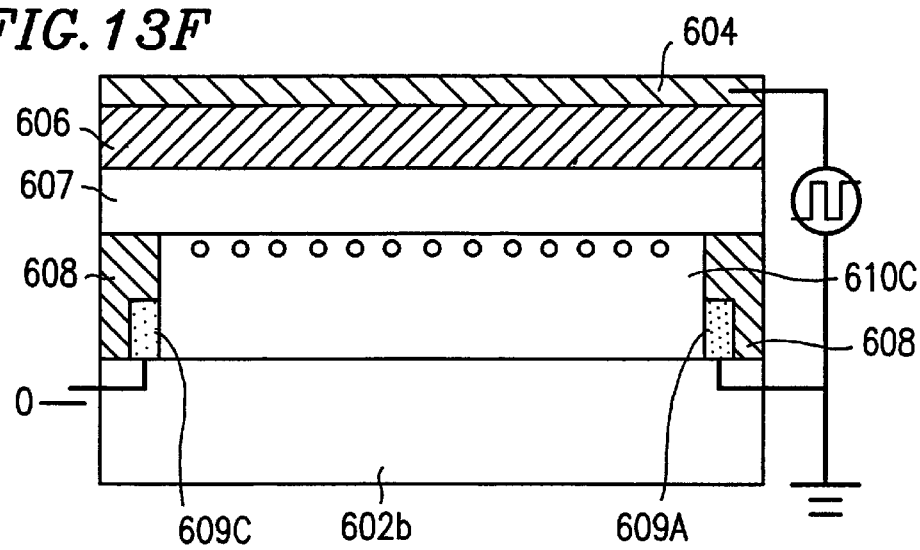

On the other hand, the dielectric sheet 607 interface may also be positively charged in a manner illustrated in FIGS. 13D to 13F. First, a voltage Ed of about −50 V to about −100 V is applied to the transparent electrode line 604 of the color filter substrate 610A.

The plasma addressing display device 600 of Example 6 provides an advantage that the aperture ratio of the device is increased without detracting from the characteristics of the electrode line (e.g., the anode 609A and the cathode 609C), while it is also possible to realize a uniform electric discharge with a low discharge voltage.

Hereinafter, a method for producing the plasma addressing display device 600 of this example will be described with reference to FIGS. 14A to 14E.

Figure 14A:
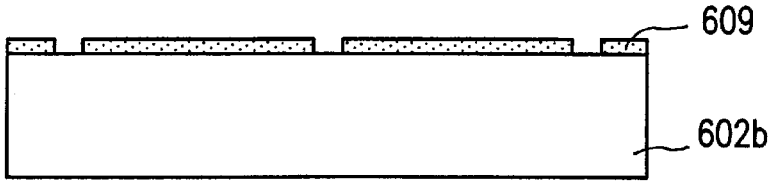
FIGS. 14A to 14E are cross-sectional views illustrating a method for producing the plasma addressing display device according to Example 6 of the present invention.

First, an electrode material layer 609 is formed on the transparent substrate 602*b*, as illustrated in FIG. 14A, by a printing process, or the like. The gaps seen in the electrode material layer 609 will each be a separation between two adjacent electrode lines (e.g., the anode 609A and the cathode 609C).

Figure 14B:
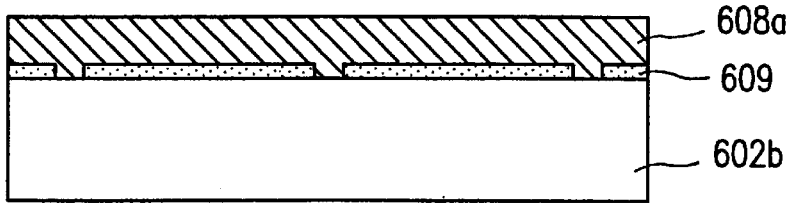

Then, an insulative material layer 608*a* is formed on the electrode material layer 609, as illustrated in FIG. 14B, by a printing process, or the like.

Figure 14C:
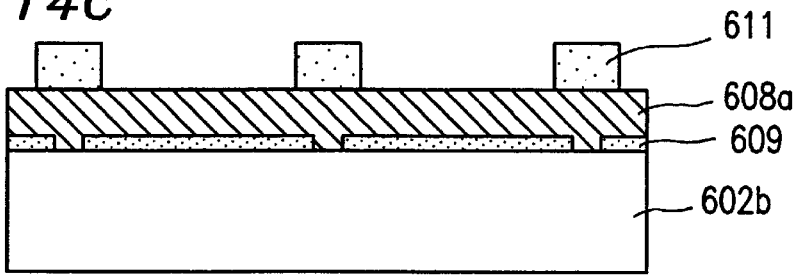
Figure 14D:
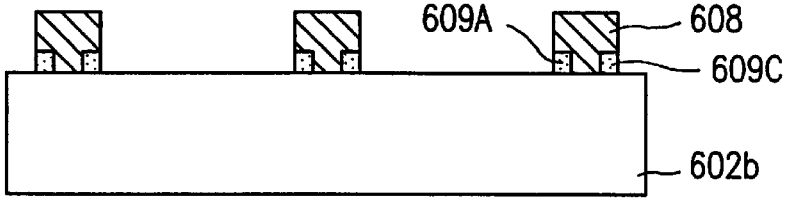

Then, a mask or a resist 611 is formed on the insulative material layer 608*a*, as illustrated in FIG. 14C. Successively, the insulative material layer 608*a* and the electrode material layer 609 are partially removed by a physical or chemical etching process so as to form the partition wall 608, with the electrode lines (e.g., the anode 609A and the cathode 609C) being buried on respective sides thereof, as illustrated in FIG. 14D.

Figure 14E:
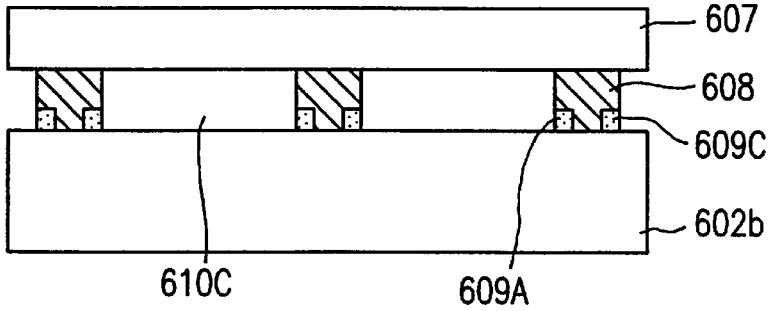

Finally, a dielectric sheet 607 is deposited on the partition walls 608, as illustrated in FIG. 14E, and then an inert gas is introduced into the plasma discharge channels 610C each being a space enclosed by the transparent substrate 602*b*, two adjacent partition walls 608 and the dielectric sheet 607.

Thus, the plasma addressing section is obtained, which is further provided with the polarizer 601*b* and the alignment film 605*b*, thereby obtaining the plasma addressing substrate 610B.

On the other hand, the color filter substrate 610A, as illustrated in FIG. 11, is produced. Then, the color filter substrate 610A and the plasma addressing substrate 610B are attached together so as to oppose each other. At this time, it is ensured that the plasma discharge channel 610C and the transparent electrode line 604 of the color filter substrate 610A are in the "skew relationship" with respect to each other. A liquid crystal material is injected between the opposing substrates 610A and 610B, and the backlight 610 is provided on the plasma addressing substrate 610B side of the display device 600, thereby completing the plasma addressing display device 600 of the present example.

According to the present example, a complicated printing technique is not required for forming the partition walls 608 and the electrode lines (e.g., the anode 609A and the cathode 609C). Moreover, since the electrode lines (e.g., the anode 609A and the cathode 609C) are buried in the partition walls 608 of an insulative material, there is only little change over time in the edges of the electrode lines (e.g., the anode 609A and the cathode 609C), thereby enhancing the reliability of the device.

The etching process employed in the above-described production may be a physical etching process such as a sand blasting process, a chemical etching process including a dry etching process such as those using hydrogen fluoride or hydrogen bromide and a wet etching process such as those using an aqueous solution of hydrogen fluoride, or any other appropriate processes.

The plasma addressing display device which is produced by such a production method provides an advantage that the aperture ratio thereof is increased, while it is possible to realize a uniform electric discharge with a low discharge voltage and to realize a high definition display.

As described above, according to the present invention, each region where two plasma discharge channels overlap one transparent electrode line corresponds to a picture element of the color filter. Such a display device can be driven by employing a conventional driving method by applying a predetermined potential to the middle one of three adjacent electrode lines included in each picture element, while setting the outer ones of the three adjacent electrode lines at a ground potential. Thus, it is possible to increase the aperture ratio while employing the conventional driving method, as illustrated in FIGS. 16A to 16F.

In the case where the partition wall is formed on the electrode line with their widths being identical to each other, the electrode line can still be exposed to the gas contained in the plasma discharge channel, by forming the partition wall so that a portion of the partition wall in the vicinity of the electrode line has a width smaller than that of the other portion of the partition wall. In such a case, the partition wall and the electrode line will create a single, overlapping light blocking area, whereby the aperture ratio is further increased. Furthermore, since the exposed area of the electrode line can be thus increased, the electric discharge is stabilized.

Also when the partition wall and the electrode line are formed to have an identical width along their entire extent in the height direction, the partition wall and the electrode line will create a single, overlapping light blocking area. Therefore, the aperture ratio is increased, and there is only little change over time in the edges of the electrode lines, thereby enhancing the reliability of the device. Such a plasma addressing display device can be easily produced by employing a conventional printing process.

According to a production method of the present invention, a printing method is not employed in forming the partition wall, thereby eliminating the need for a complicated printing technique such as precise alignment. Moreover, since the electrode line is buried in the partition wall formed of an insulative material, there is only little change over time in the edges of the electrode lines, thereby enhancing the reliability of the device, and the formation of the electrode line is facilitated.

According to another aspect of the present invention, the two electrode lines which are insulated by a portion of the partition wall are formed to overlap the partition wall. Therefore, the aperture ratio is increased, whereby the brightness of the display is less likely to be lowered. Accordingly, the requirement for the backlight performance is reduced, thus reducing the cost of the device.

According to another production method of the present invention, an electrode material and an insulative partition wall material are deposited on transparent substrate, and then partially etched away using a mask or a resist, thereby forming a partition wall with electrode lines buried therein. Thus, the aperture ratio can be increased. Moreover, an electric discharge can be caused between electrodes which are facing each other, whereby it is possible to realize a uniform electric discharge with a low discharge voltage. Furthermore, since the electrode lines are buried in a partition wall formed of an insulative material, there is only little change over time in the edges of the electrode lines (e.g., an anode and a cathode), thereby enhancing the reliability of the device.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A plasma addressing display device, comprising: a plasma addressing substrate; a color filter substrate; and a display medium layer interposed between the plasma addressing substrate and the color filter substrate, the plasma addressing substrate comprising: a first substrate; a dielectric sheet provided near the display medium layer; a plurality of electrode lines provided at regular intervals on the first substrate; a plurality of partition walls provided respectively on the plurality of electrode lines; and a plurality of strip plasma discharge channels each enclosed by the first substrate, the dielectric sheet and the partition walls, the color filter substrate comprising: a second substrate; a color filter layer provided on the second substrate; a plurality of strip electrodes provided on the color filter layer so as to extend in a direction orthogonal to the plurality of strip plasma discharge channels, wherein a picture element is defined by a region where adjacent two of the plasma discharge channels overlap one of the plurality of strip electrodes.

2. A device according to claim 1, wherein a width of a portion of the partition wall in a vicinity of a junction between the partition wall and the electrode line is less than a width of a remaining portion of the partition wall.

3. A device according to claim 1, wherein a width of the partition wall and a width of the electrode line are identical to each other and constant in a height direction.

4. A method for producing a plasma addressing display device, comprising the steps of:

(a) printing an electrode material on a first substrate so as to form an electrode line on the first substrate;

(b) printing a partition wall material on the electrode line so as to form a first portion of a partition wall which has a width less than a width of the electrode line; and (c) printing a partition wall material on the first portion so as to form a remaining portion of the partition wall which has a width greater than the width of the first potion.

5. A method according to claim 4, wherein the remaining portion of the partition wall has a width substantially identical to the width of the electrode line.

6. A method according to claim 4, wherein in the steps (b) and (c), the partition wall material is printed iteratively.

7. A plasma addressing display device, comprising: a plasma addressing substrate; a color filter substrate; and a display medium layer interposed between the plasma addressing substrate and the color filter substrate, the plasma addressing substrate comprising: a first substrate; a dielectric sheet provided near the display medium layer; a plurality of partition walls provided at regular intervals on the first substrate; a plasma discharge channel formed by introducing a gas into a space enclosed by the first substrate, the dielectric sheet and the partition walls, wherein two electrode lines are provided on the first substrate so as to be at least partially buried in respective sides of the partition wall and insulated from each other by the partition wall.

8. A device according to claim 7, wherein the partition wall includes a notch portion where the electrode lines are buried, and a width of the notch portion is less than a width of a remaining portion of the partition wall.

9. A device according to claim 7, wherein the two electrode lines are entirely buried in respective sides of the partition wall.

10. A device according to claim 7 wherein one of the two electrode lines are an anode and a cathode, respectively, and a voltage necessary for causing an electric discharge is applied to the cathode.

11. A device according to claim 7, wherein a color filter substrate including a color filter and a strip electrode is provided on the dielectric sheet, and a voltage necessary for writing data is applied to the strip electrode.

12. A device according to claim 11, wherein the plasma discharge channel and the strip electrode line are orthogonal to each other, and a picture element is defined by a region where the plasma discharge channel and the strip electrode overlap each other.

13. A plasma addressing display comprising:

a plasma addressing substrate including a plurality of parallel plasma discharge channels;

a color filter substrate including a plurality of strip electrodes as well as a plurality of color filters, wherein said strip electrodes extend in a direction orthogonal to lengths of said plasma discharge channels;

a display medium layer disposed between said plasma addressing substrate and said color filter substrate;

a plurality of picture elements or pixels; and wherein at least some of said picture elements or pixels are each defined by an area or region where first and second adjacent plasma discharge channels overlap one of said strip electrodes.

* * * * *